US005149902A

United States Patent [19]

Washiyama

[11] Patent Number: 5,149,902

[45] Date of Patent: Sep. 22, 1992

[54] ELECTRONIC MUSICAL INSTRUMENT USING FILTERS FOR TIMBRE CONTROL

[75] Inventor: Yutaka Washiyama, Hamamatsu, Japan

[73] Assignee: Kabushiki Kaisha Kawai Gakki Seisakusho, Japan

[21] Appl. No.: 619,864

[22] Filed: Nov. 29, 1990

[30] Foreign Application Priority Data

Dec. 7, 1989 [JP] Japan ..... 1-316514
Jan. 29, 1990 [JP] Japan ..... 2-161521

[51] Int. Cl.[5] ..... G10H 1/12

[52] U.S. Cl. ..... 84/622; 84/661; 84/DIG. 9; 364/723; 364/724.01

[58] Field of Search ..... 84/622-625, 84/661, 699, 700, 736, DIG. 9; 364/723-724.2

[56] References Cited

U.S. PATENT DOCUMENTS 4,554,858 11/1985 Wachi et al. ..... 84/DIG. 9
4,677,889 7/1987 Deutsch ..... 84/623 X
4,736,663 4/1988 Wawrzynek et al. ..... 84/DIG. 9
4,738,179 4/1988 Hideo .
4,843,938 7/1989 Hideo .

FOREIGN PATENT DOCUMENTS 59-44096 3/1984 Japan .
60-52895 3/1985 Japan .

*Primary Examiner*—Stanley J. Witkowski
*Attorney, Agent, or Firm*—Andrus, Sceales, Starke & Sawall

[57] ABSTRACT

A filter calculating section has a plurality of basic filters formed on a time-divisional basis. The timbre of a musical tone signal is controlled by a memory section, an accumulator, a selector, an I/O assign section and a control section using the basic filters formed by the filter calculating section. A digital filter coefficient stored in a digital filter coefficient memory is read out using integer data output from a cutoff controller as an address. An interpolation circuit interpolates this digital filter coefficient on the basis of fraction data output from the cutoff controller. Based on the interpolated digital filter coefficient, the timbre of a musical tone signal is controlled.

10 Claims, 21 Drawing Sheets

S 1

S 1

Fig. 6A
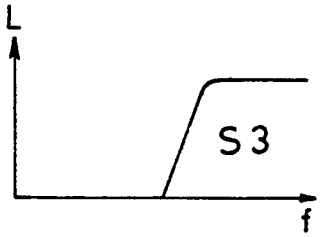
Fig. 6B
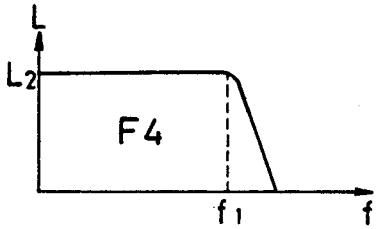
Fig. 6C
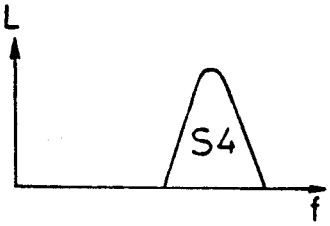
Fig. 7
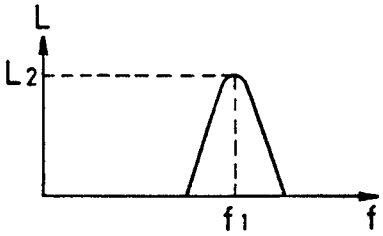
Fig. 8
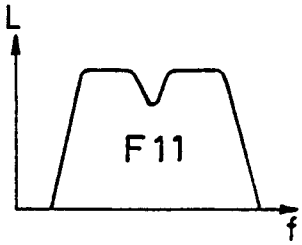
Fig. 9A
S11
Fig. 9B
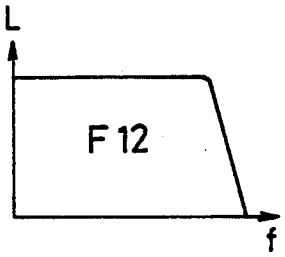
Fig. 9C
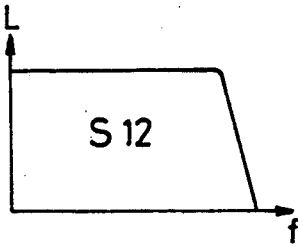

ELECTRONIC MUSICAL INSTRUMENT USING FILTERS FOR TIMBRE CONTROL

BACKGROUND OF THE INVENTION

1. Field of the Invention

The present invention relates to an electronic musical instrument which can control the timbre of a musical tone using a filter.

2. Description of the Related Art

A conventional electronic musical instrument, such as an electronic organ, is designed to control the timbre of a musical tone using an analog filter.

Recently, a digital filter has been used in various types of electronic apparatuses.

In an acoustic apparatus, such as a compact disk player (hereafter referred to as "CD player"), or a digital audio tape player (hereafter referred to as "DAT player"), the digital filter serves to cut aliasing noise.

The digital filter may also be used in the electronic musical instrument to control the timbre of a musical tone.

Digital filter are classified into two types; a finite impulse response type (hereafter referred to as "FIR type") and an infinite impulse response type (hereafter referred to as "IIR type").

The FIR type digital filter is conventionally used in the acoustic apparatuses; this filter may also be employed in the electronic musical instruments.

In order to acquire a desirable filter property, however, the FIR type digital filter theoretically needs execution of an infinite series of delays, thereby requiring a great number of filter coefficients. If the filter is designed approximately, 256 stages of delays have to be done, and a very large number of filter coefficients are required accordingly.

Although the FIR type digital filter can be used in acoustic apparatuses, therefore, its use in electronic musical instruments would be difficult.

The acoustic apparatuses use a constant signal sampling frequency of a signal, so that there needs only one frequency response of the filter for eliminating the aliasing noise. It does not therefore matter much in this case if many filter coefficients are necessary.

On the other hand, the electronic musical instruments require that a plurality of timbres be switched from one to another from time to time; the filter coefficients should also be switched from time to time accordingly. Many filter coefficients would disturb the smooth selection, and further complicate the filter structure.

As a solution to this problem, the IIR type digital filter may replace the FIR type because the former digital filter has fewer filter coefficients than the latter.

The IIR type digital filter still requires a considerable number of filter coefficients, though reduced, to accurately express the timbres. The use of the IIR type digital filter cannot therefore completely overcome the aforementioned shortcoming.

Further, the digital filter has an inherent rough characteristic, thereby deteriorating the smoothness of musical tones.

SUMMARY OF THE INVENTION

Accordingly, it is an object of the first present invention to provide an electronic musical instrument which can control the timbre of a musical tone with fewer filter coefficients.

To achieve this object, multiple basic filters are combined a needed based on timbre control information to control the timbre.

It is an object of the second present invention to provide an electronic musical instrument which is designed to use a digital filter but can generate a smooth musical tone.

To achieve this object, filter coefficients are interpolated to control the timbre.

BRIEF DESCRIPTION OF THE DRAWINGS

FIG. 3 to 14 are characteristic diagrams of frequency responses for explaining the operation of the filter shown in FIG. 2;

DETAILED DESCRIPTION OF THE PREFERRED EMBODIMENTS

Figure 1:
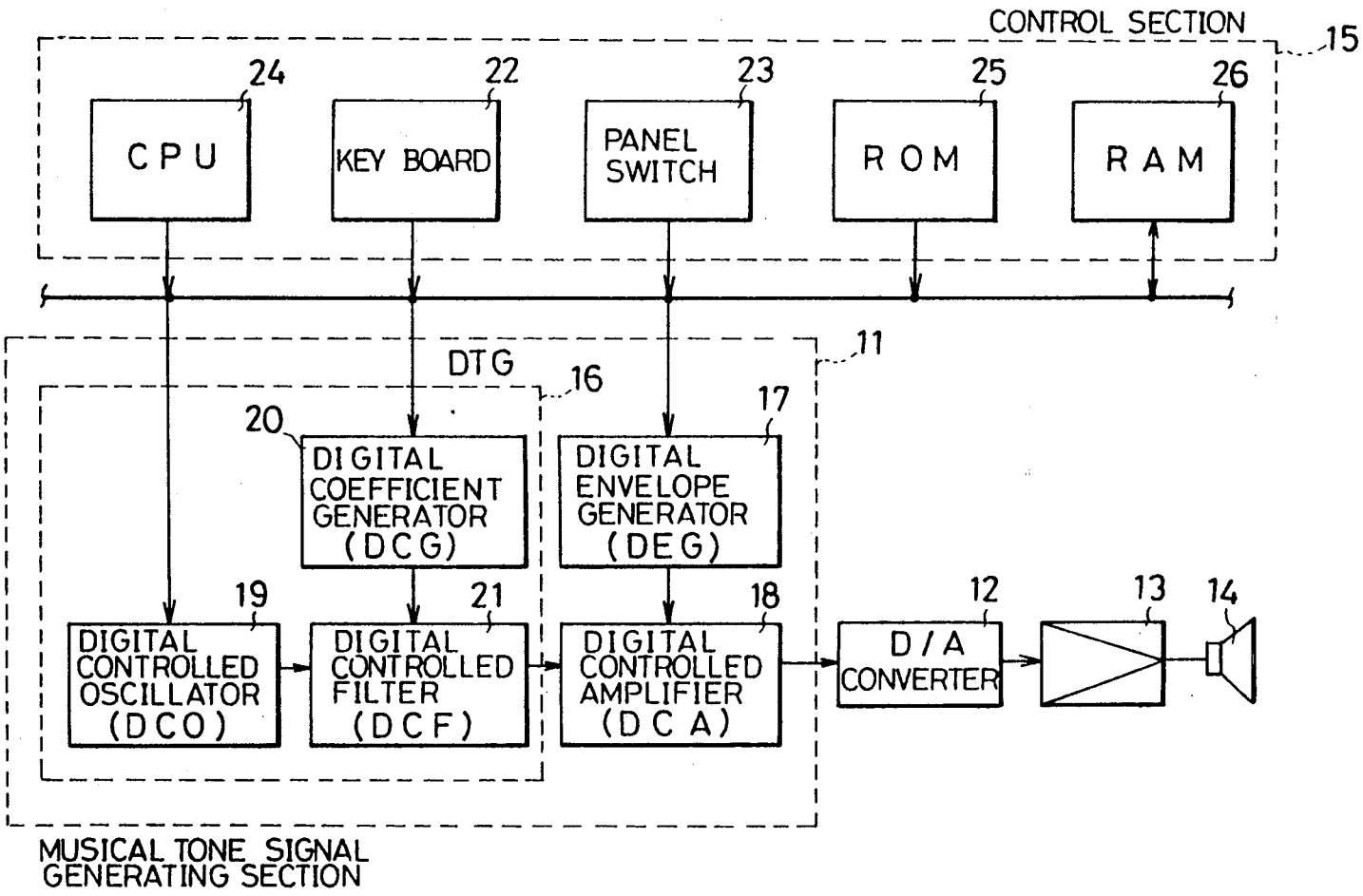
FIG. 1 is a block diagram exemplifying the general structure of an electronic musical instrument to which the first and second inventions are applied.

The first and second inventions will now be described referring to the accompanying drawings.

A description referring to FIG. 1 will now be given of the general structure of one example of an electronic musical instrument to which the first and second inventions are applied.

Reference numeral "11" denotes a musical tone signal generating section.

A D/A converter 12 converts the musical tone signal output from the musical tone signal generating section 11 to an analog signal.

An amplifier 13 amplifies the musical tone signal output from the D/A converter 12.

A loudspeaker (or a headphone) 14 releases a musical tone in the air, based on the musical tone signal output from the amplifier 13.

A control section 15 controls each section of the electronic musical instrument, such as the musical tone signal generator 11.

The musical tone signal generating section 11 includes a digital tone generator 16 (hereafter referred to as "DTG"), which generates a musical tone signal that has a waveform according to the timbre, range and touch, and a frequency according to the pitch. A musical tone signal generated from the DTG 16 is hereafter referred to as "tone signal."

A digital envelope generator (hereafter referred to as "DEG") 17 generates an envelope signal which has a waveform according to the timbre.

A digital controlled amplifier (hereafter referred to as "DCA") 18 amplifies the tone signal from the DTG 16 in accordance with the envelope signal from the DEG 17 as a gain control signal.

The tone generator 16 includes a digital controlled oscillator 19 (hereafter referred to as "DCO") to output a musical tone signal which has a waveform according to the timbre. A musical tone signal from the DCO 19 is hereafter referred to as "an oscillation signal."

A digital coefficient generator (hereafter referred to as "DCG") 20 generates a filter coefficient according the timbre, range, and touch.

A digital controlled filter (hereafter referred to as "DCF") 21 filters the oscillation signal from the DCO 13, based on the filter coefficient output from the DCG 14.

The control section 15 comprises a keyboard 22 that has keys and a key scanner to detect the touched status of each key. The key scanner outputs a key code indicating a depressed key, and a touch data indicating how the key is touched, such as strength and speed.

A panel switch section 23 includes a timbre select switch, a mode select switch, and a key scanner to detect the operating of these switches.

A CPU (Central Processing Unit) 24 controls the individual sections of the electronic musical instrument.

An ROM (Read Only Memory) 25 stores a program for operating the CPU 24, and various fixed data. The various fixed data include a timbre code to specify a timbre, range data to designate a range, a frequency number to specify the frequency of a tone signal, and a parameter to generate an envelope signal.

An RAM (Random Access Memory) 26 serves as a work memory of the CPU 24.

The tone generating operation of the thus structured musical tone generating section will now be described.

The CPU 24 reads a frequency number and range data, which correspond to a key code supplied from the keyboard 22, from the ROM 25. The CPU 24 sends the frequency number to the DCO 19 and the range data to the DCG 20.

The CPU 24 also sends touch data supplied from the keyboard 22 to the DCG 20.

Further, the CPU 24 reads from the ROM 25 a timbre code corresponding to the timbre which has been selected by the timbre selecting switch of the panel switch section 23, and supplies the timbre code to the DCO 19 and the DCG 20.

The CPU 24 reads from the ROM 25 a parameter for generating an envelope signal associated with the timbre which has been selected by the timbre selecting switch of the panel switch section 23. The CPU 24 sends the parameter to the DEG 17.

Accordingly, the DCO 19 outputs an oscillation signal which has a frequency according to the frequency number and a waveform according to the timbre code. The DCG 20 gives a filter coefficient which has a value according to range data, the timbre code, and touch data. The DEG 17 produces an envelope signal with a waveform according to the timbre code.

The DCF 21 filters the oscillation signal from the DCO 19 based on the filter coefficient from the DCG 20, outputting a tone signal whose timbre is controlled based on the range data, the timbre code, and the touch data.

The DCA 18 amplifies the tone signal from the DCF 21, with the envelope signal from the DEG 17 serving as a gain control signal, thus yielding a musical tone signal with an amplitude according to that of the envelope signal.

The musical tone signal is converted into an analog signal by the D/A converter 12, and is then supplied to the loudspeaker (or the headphone) 14 via the amplifier 13 to release a musical sound in the air.

As described above, the electronic musical instrument shown in FIG. 1 is designed such that the DTG 16 determines the timbre of a musical tone signal, and the DCA 18 affixes the strength property to the musical tone signal.

Figure 2:
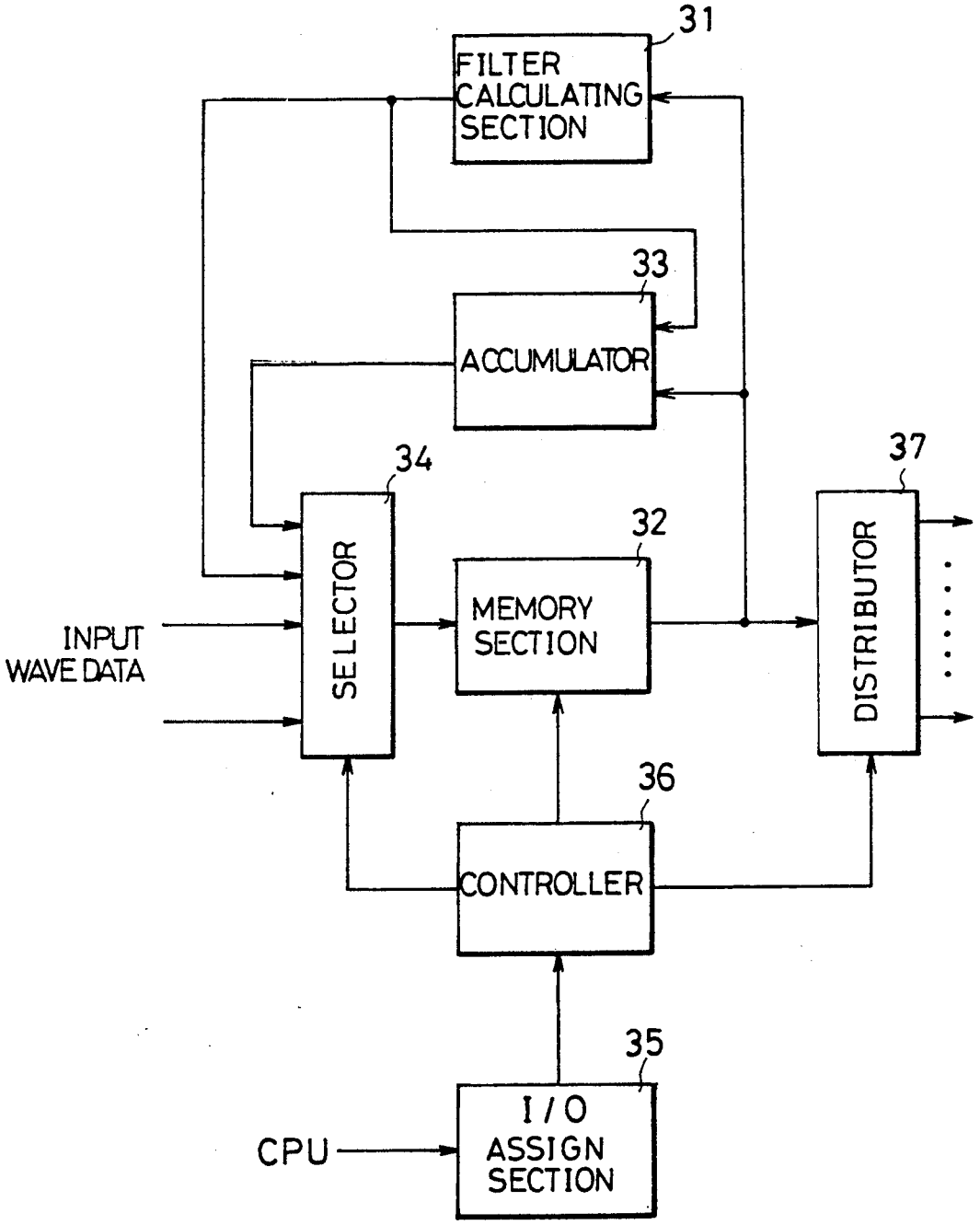
FIG. 2 is a block diagram illustrating the structure of a digital controlled filter in FIG. 1 according to the first embodiment of the first invention.

A description will now be given of the structure of one embodiment of the first invention referring to FIG. 2, which illustrates the structure of the DCF 21 of the first invention shown in FIG. 1.

To begin with, the outline of the embodiment will be described, referring to FIGS. 3 to 18.

According to this embodiment, a plurality of filters with different frequency responses are constituted by the proper combination of basic filters with a flat frequency response, such as a high-pass filter (hereafter referred to as "HPF") and a low-pass filter (hereafter referred to as "LPF").

Figure 3:
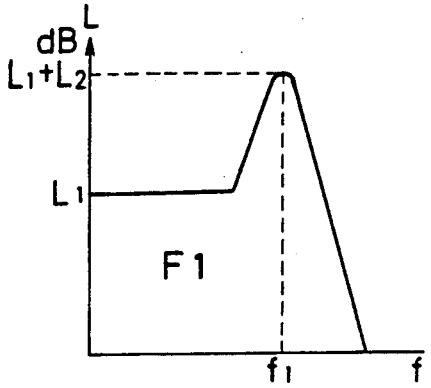

For example, a filter Fl with a frequency response shown in FIG. 3 is attained by combining basic filters F2 to F4 respectively having frequency responses shown in FIGS. 4 to 6.

Figures 4A, 4B, 4C:
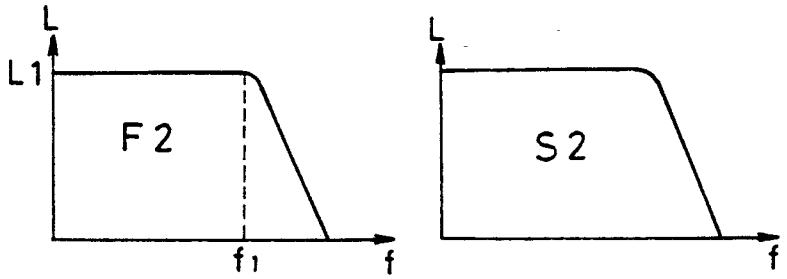
Figures 5A, 5B, 5C:
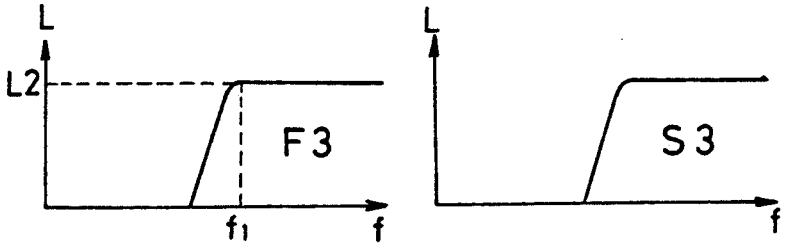

FIGS. 4B, 5B, and 6B respectively show the frequency responses of the basic filters F2 to F4. FIGS. 4A, 5A, and 6A exemplify input signals to the respective basic filters F2 to F4. FIGS. 4C, 5C and 6C illustrate output signals to these input signals.

In FIGS. 3 to 6, the horizontal scale is a frequency f, and the vertical scale a level L; the same will be applied to other frequency response diagrams.

FIG. 3 illustrates the frequency response of a filter for acquiring a musical tone signal of, for example, a trumpet.

The basic filters F3 and F4 in FIGS. 5 and 6 are combined together, forming a band-pass filter (hereafter referred to as "BPF") in FIG. 7. The BPF is combined with the filter F2 in FIG. 4, providing the filter F1 in FIG. 3.

The oscillation signal from the DCO 19 in FIG. 1 is supplied as an input signal S1 to the basic filters F2 and F3, thereby acquiring signals S2 and S3 shown in FIGS. 4C and 5C.

The frequency spectrum of the signal S1 is not illustrated in the drawing because it varies according to the frequency number and timbre code of the signal.

The signal S3 is sent to the basic filter F4, providing a signal S4 with a frequency spectrum shown in FIG. 6C. The signal S4 is added to the signal S2, making a tone signal with a frequency spectrum shown in FIG. 3.

The filter F1 shown in FIG. 3 may be formed by connecting the basic filter F2 in parallel to the basic filters F3 and F4 connected in series.

The DCF 21 in FIG. 1 forms the basic filters F2 to F4 one by one on the time-divisional base, thus forming the filter F1 in FIG. 3.

The DCF 21 serves to set the cutoff frequencies and output levels L of the basic filters F2 to F4, based on the filter coefficients from the DCG 20.

To obtain a filter 11 with a frequency response shown in FIG. 8, basic filters F12 to F15 having respective frequency responses shown in FIGS. 9 to 12 are used.

FIGS. 9 to 12 like FIGS. 4 to 6 illustrate the frequency spectra of input and output signals.

The oscillation signal from the DCO 19 is sent as a signal S11 to the basic filter F12 so as to make a signal S12 with a frequency spectrum shown in FIG. 9C.

Figure 10A:
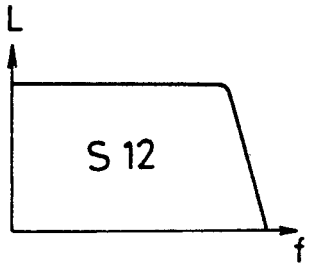
Figure 10B:
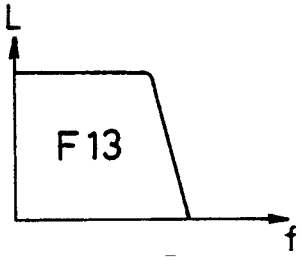
Figure 10C:
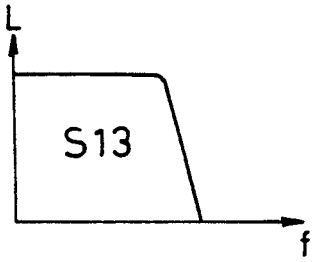
Figure 11A:
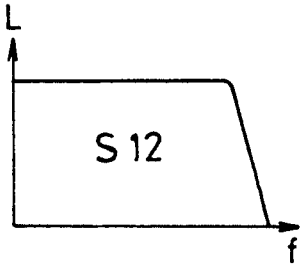
Figure 11B:
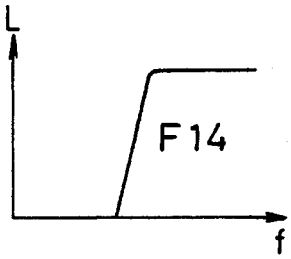
Figure 11C:
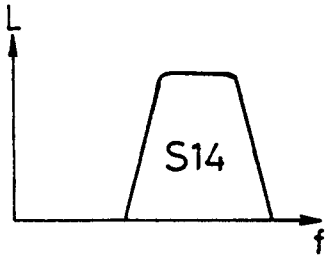

The signal S12 is supplied to the basic filters F13 and F14, which in turn output signals S13 and S14 with the respective frequency spectra shown in FIGS. 10C and 11C.

Figure 12A:
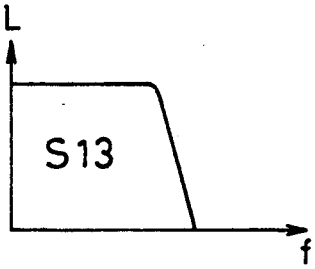
Figure 12B:
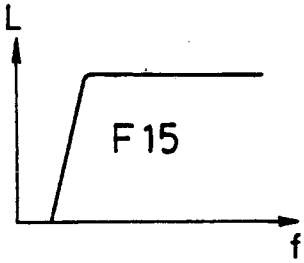
Figure 12C:
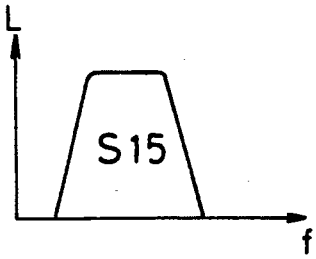

The signal S13 is sent through the basic filter F15 to be a signal S15 with a frequency spectrum shown in FIG. 12C.

Composition of the signals S14 and S15 yields a tone signal with the frequency spectrum shown in FIG. 8.

Figure 13:
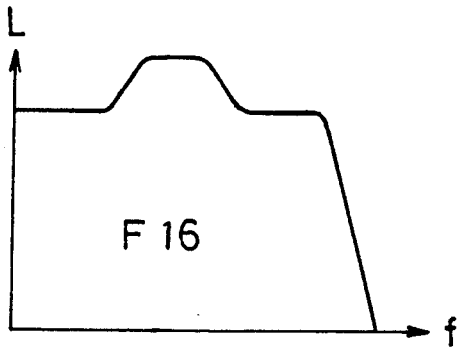

Likewise, a filter F16 with a frequency response shown in FIG. 13 can be provided by combining the basic filters F12, F13, and F15. This is because a tone signal with the frequency spectrum shown in FIG. 13 is acquired by composing the signal S12 from the basic filter F12 and the signal S15 from the basic filters F13 and F15.

Figure 14:
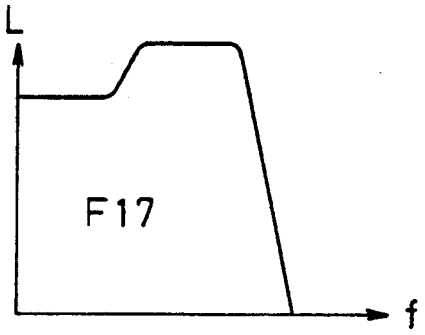

Also, a filter F17 with a frequency response in FIG. 14 can be formed by the combination of the basic filters F12, F13 and F15, since a tone signal with the frequency spectrum in FIG. 14 is attained by synthesizing the signal S13 acquired by the basic filters F12 and F13, and the signal S15 acquired by the basic filters F12, F13, and F15.

According to the aforementioned embodiment, a filter with any frequency response is formed by properly combining multiple basic filters based on the timbre code, the range data and the touch data.

An electronic musical instrument generally requires a filter with a complicated frequency response, such as the aforementioned filters F1, F11, F16, and F17.

The tone signal, however, sometimes has such a flat frequency spectrum as shown in FIG. 9C.

In this case, no combination of the basic filters is necessary, but only the basic filter F12 is required.

The structure shown in FIG. 2 will now be described.

A filter calculating section 31 sequentially forms multiple basic filters in a predetermined order, based on the filter coefficient output from the DCG 20 in FIG. 1.

A memory section 32 stores input wave data, the results of calculation, and output wave data.

The input wave data is, for example, the signal S11 in FIG. 9A, i.e., the oscillation signal from the DCO 19 in FIG. 1. The calculation results may be the signals S12 to S15 in FIGS. 9C to 12C, i.e., filtered outputs from the respective basic filters F12 to F15. The output wave data is a signal with the frequency spectrum in FIG. 8, i.e., the tone signal output from the DCF 21 in FIG. 1.

An accumulator 33 adds data read out from the memory section 32 to the filtered output from the filter calculating section 31, generating a signal with the frequency spectrum shown in FIG. 8.

A selector 34 selects the input wave data, the calculation results, or the output from the accumulator 33, and supplied the selected data to the memory section 32.

An input/output assign section 35 generates assign information for storing the input wave data, the calculation results, and the output wave data in the memory section 32, based on the timbre code, the key data, and the touch data which are supplied from the CPU 24.

A controller 36 controls the selecting operation of the selector 34 and the write/read operation of the memory section 32 based on the assign information output from the I/O assign section 35.

A distributor 37 distributes the output wave data in individual tone-ON channels, which are time-divisionally read out from the memory section 32, to output ports corresponding to these tone-ON channels. The distribution of this distributor 37 is also controlled by the controller 36.

Figure 15:
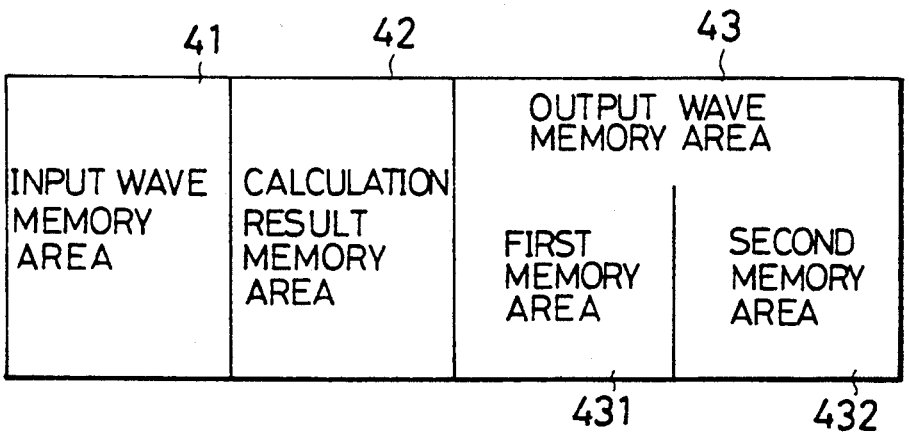
FIGS. 15 and 16 are diagrams for explaining the operation of the filter shown in FIG. 2.

FIG. 15 illustrates how data is stored in the memory section 32.

As shown in this diagram, the memory section 32 includes an input wave memory area 41, a calculation result memory area 42, and an output wave memory area 43. The output wave memory area 43 is separated into first and second memory areas 431 and 432.

The input wave memory area 41 stores the input wave data.

If there are multiple tone-ON channels, the wave data of the individual channels are time-divisionally stored in the input wave memory area 41. The same will be applied to the calculation result memory area 42 which will be described next.

If the input wave data of each tone-ON channel includes plural pieces of wave data, each wave data is stored in a separate area.

The output wave data is stored in the output wave memory area 43.

The first and second memory areas 431 and 432 are alternately used as a data read memory area and a data write memory area.

In other words, when the output wave data of a tone-ON channel is stored in the first memory area 431, the output wave data is read out from the first memory area, while the output wave data of the next tone-ON channel is written in the second memory area 432. When the reading and writing are completed, then the output wave data is read out from the second memory area 432, and the output wave data of the next tone-ON channel is written in the first memory area 431.

If there is only one output system, one set of the first and second memory areas 431 and 432 is sufficient. If there are two output systems, such as an upper keyboard and a lower keyboard, however, two sets of the memory areas 431 and 432 are required. In a case of a pedal key added to those output systems, for example, one more set is necessary.

Figure 16:
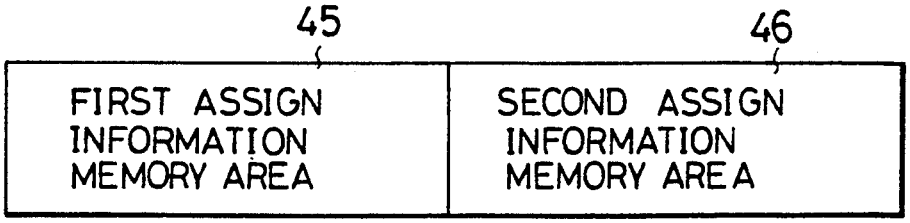

FIG. 16 illustrates the data storage structure of an assign information memory section located in the I/O assign section 35.

As illustrated, the assign information memory section has first and second assign information memory areas 45 and 46. In the first assign information memory area 45 is stored the assign information of the input wave data, while in the second area 46 is stored the assign information of the output wave data.

The operation of the above-described structure will now be depicted.

The following explanation is specifically about acquiring the output wave data with the frequency spectrum shown in FIG. 8.

The signal S11 shown in FIG. 9A, which is output from the DCO 19 in FIG. 1, is written via the selector 34 into the input wave memory area 41 in the memory section 32.

The signal S11 is then read from the input waveform memory area 41, and is supplied to the filter calculating section 31.

Since the basic filter F12 in FIG. 9B has been set in the filter calculating section 31 by this time, the signal S11 is filtered by the basic filter F12, yielding the signal S12 shown in FIG. 9C.

The signal S12 is sent via the selector 34 to the memory section 32 and is stored in the calculation result memory area 42 thereof.

Then, the signal S12 is read out from the memory area 42 and supplied to the filter calculating section 31.

As the basic filter F14 in FIG. 11B has been set in the filter calculating section 31 by this time, the signal S12 is filtered by the basic filter F14, providing the signal S14 shown in FIG. 11C.

The signal S14 is sent via the selector 34 to the memory section 32, and is stored in the memory area 42 thereof, but at a the different part from where the signal S12 has been stored.

Then, the signal S12 in the memory area 42 is read out again and is sent to the filter calculating section 31.

As the filter calculation section 31 has the basic filter F13 in FIG. 10B set therein by this time, the signal S12 is filtered by the basic filter F13, yielding the signal S13 shown in FIG. 10C.

The signal S13 is supplied via the selector 34 to the memory section 32, and is stored in the memory area 42 thereof, but at a different part from where the signals S12 and S14 are stored.

Then, the signal S13 is read from the calculation result memory area 42, and is sent to the filter calculating section 31.

Since the basic filter F15 in FIG. 12B has been set in the filter calculating section 31 by this time, the signal S13 is filtered by the basic filter F15, thus providing the signal S15 shown in FIG. 12.

The signal S15 is sent to the accumulator 33, and is added to the data read from the memory section 32, i.e., the signal S14 stored in the memory area 42. In other words, the signal S15 is added to the signal S14 by the accumulator 33, thus yielding the tone signal with the frequency spectrum shown in FIG. 8.

The tone signal is supplied via the selector 34 to the memory section 32, and is stored in the output wave memory area 43 in the memory section 31. In this case, the tone signal is stored in, for example, the first memory area 431 of the output wave memory area 43.

The tone signal is then read from the first memory area 431, and is sent to the distributor 37. At the same time the device shown in FIG. 2 generates a tone signal of the next tone-ON channel, e.g., a tone signal with the frequency spectrum shown in FIG. 13. This tone signal generation is done in the same manner as described above, and the generated tone signal is stored this time in the second memory area 432.

The read access to the first memory area 431, and the read/write access to the input wave memory area 41, the calculation result memory area 42, and the second memory area 432 are executed on the time-divisional basis to avoid contention.

When writing of the tone signal in the second memory area 432 is completed, the tone signal is read from that area 432, while a tone signal of the next tone-ON channel is written in the first memory area 431.

The same process will be taken to all the remaining tone-ON channels; this process continues while any key is being depressed.

The filter calculation will now be described in detail.

Figure 17:
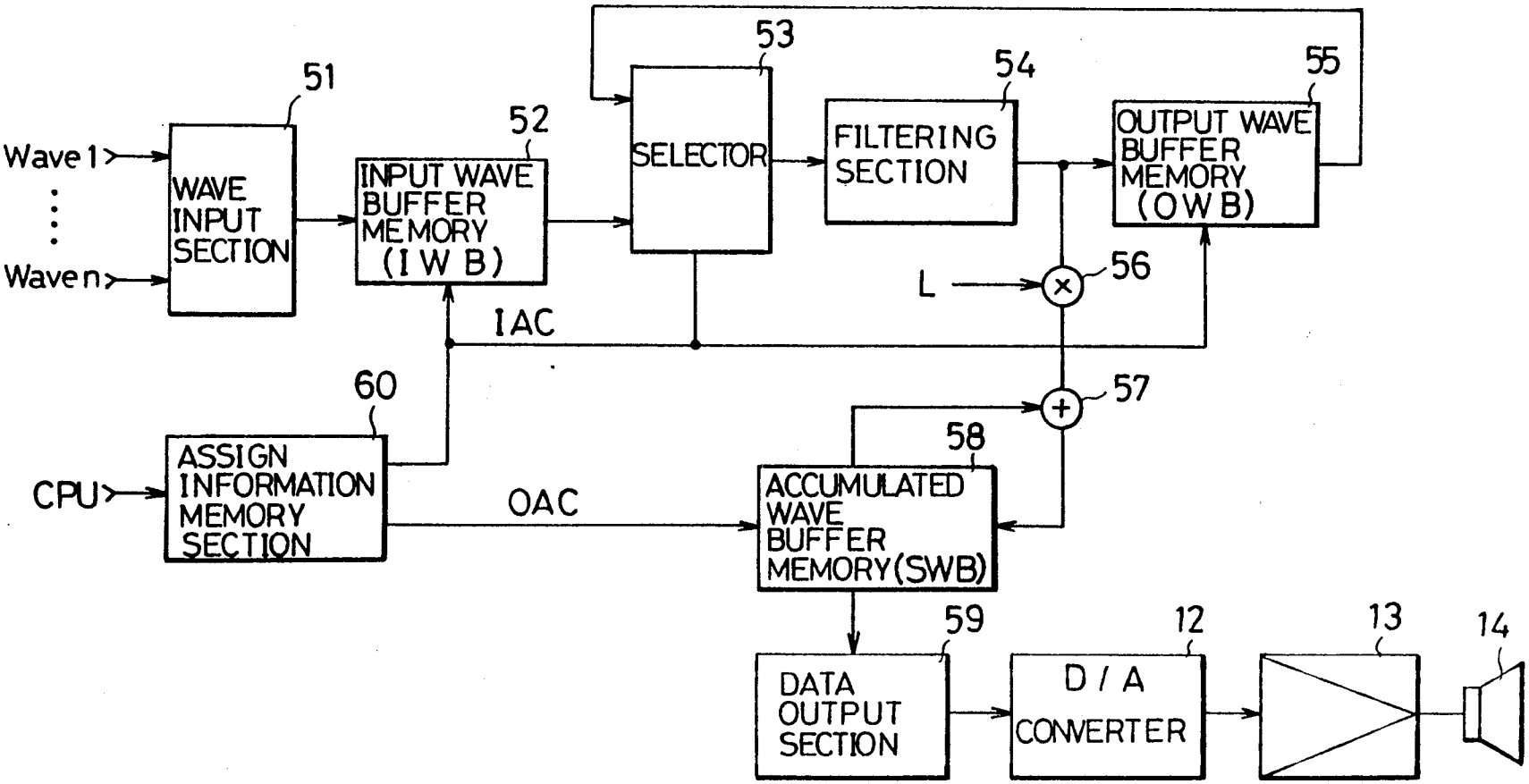
FIG. 17 is a block diagram illustrating essential sections of the filter shown in FIG. 2.

FIG. 17 is a block diagram illustrating one structure for the filter calculation.

A wave input section 51 receives input wave data of each tone-ON channel.

An input wave buffer memory 52 holds the input wave data fetched in the wave input section 51.

A selector 53 selects either the data read from the input wave buffer memory 52 or the one read from an output wave buffer memory which will be described later.

A filtering section 54 filters the data selected by the selector 53.

An output wave buffer memory 55 stores the filtered output of the filtering section 54.

A multiplier 55 multiplies the filtered output of the filtering section 54 by a level control signal L.

An adder 57 adds the multiplication result from the multiplier 56 to data read from an accumulated wave buffer memory 58, which stores the result of the addition done by the adder 57.

A data output section 59 sends the data which has been read from the accumulated wave buffer memory 58, to the loudspeaker (or headphone) 14 via the D/A converter 12 and the amplifier 13. An assign information memory section 60 outputs a control signal IAC to control the write/read operations of the input wave buffer memory 52 and the output wave buffer memory 56, and a control signal OAC to control the write/read operation of the accumulated wave buffer memory 58.

Figure 18:
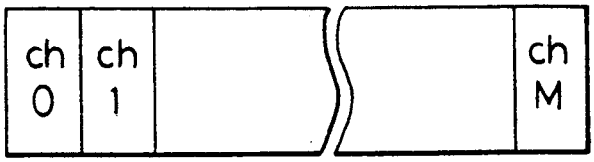
FIGS. 18 to 20 are diagrams for explaining the operation of the structure shown in FIG. 17.
Figure 19:
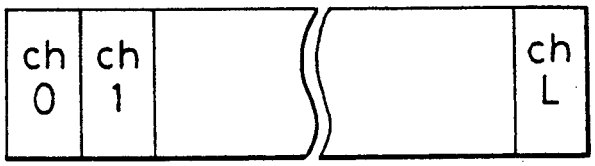
Figure 20:
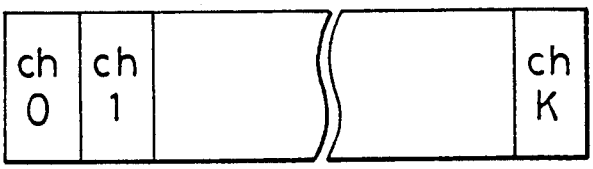

FIGS. 18 to 20 show the data storage structures of the input wave buffer memory 52, the output wave buffer memory 55, and the accumulated wave buffer memory 58.

As illustrated, each of the buffer memories 52, 55, or 58 stores wave data of multiple tone-ON channels.

The input wave buffer memory 52 is capable of storing data of the 0 to M channels, i.e., the $(M+1)$ channels. The output wave buffer memory 55 is capable of storing data of the 0 to L channels, i.e., the $(L+1)$ channels. The accumulated wave buffer memory 58 is capable of storing data of the 0 to K channels, i.e., the $(K+1)$ channels.

These channel numbers are set to have the relations, $M \leqq L$ and $K \leqq L$.

Figure 21:
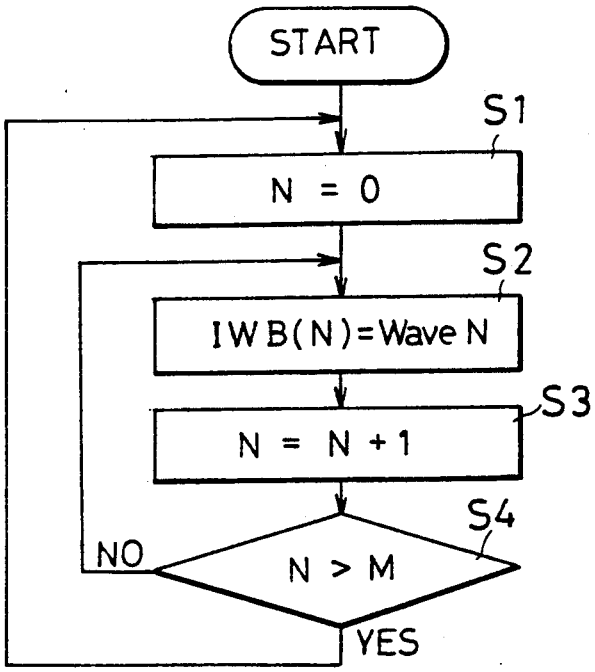
FIGS. 21 and 22 are flowcharts for explaining the operation of the structure in FIG. 17.
Figure 22:
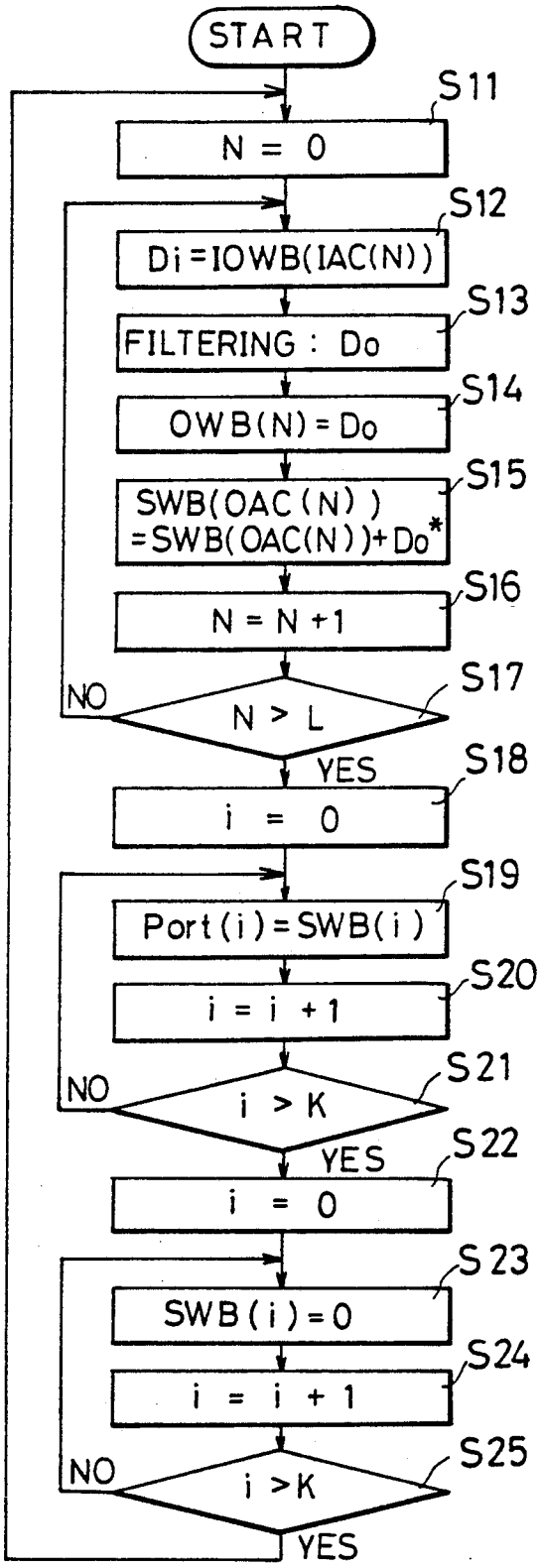

Referring to FIGS. 21 and 22, the operation of the thus constituted circuit will be described below.

FIG. 21 presents a flowchart illustrating the write operation of the input wave buffer memory 52.

In this write operation, first, the process number N is resent to "0" (step S1).

Then, input wave data with the process number N equal to "0" is written (step S2).

Next, the process number N is incremented by "1" (step S3).

Then, it is determined whether or not the process number N has reached the maximum process number M (step S4).

If the process number N has not reached the maximum process number M yet, the operation returns to step S2 and input wave data with the next process number N will be written.

If the process number N has reached the maximum process number M, the operation returns to step S1 and the process number N is reset to "0."

Through the above processing, input wave data for the entire tone-ON channels are written in the input wave buffer memory 52.

FIG. 22 is a flowchart illustrating the calculation assign process.

In this diagram, steps S11 to S17 indicate a filter calculating process, steps S18 to S21 a wave outputting process, and steps S22 to S25 a process of clearing the accumulated wave buffer memory 58.

In the calculation assign process, first, the process number N is resent to "0" (step S11).

Then, input wave data [IOWB (IAC(N))] with the process number N equal to "0" is read out from the input wave buffer memory 52 (step S12). "IOWB (IAC(N)) indicates both the input wave buffer memory 52 and the output wave buffer memory 55. This input wave data [IOWB (IAC(N))] is supplied via the selector 53 to the filtering section 54.

Next, the input wave data [IOWB (IAC(N))] is filtered by the filtering section 54, yielding a calculation result $D_0$ (step S13).

Then, the calculation result $D_0$ is stored in the output wave buffer memory 55 (step S14).

Then, the calculation result $D_0$ multiplied by the level control signal L is added to data [SWB (OAC(N))] read out from the accumulated wave buffer memory 58 by the adder 57. The result of the addition is stored in the buffer memory 58 (step S15).

Next, the process number N is incremented by "1" (step S16).

Then, it is determined whether or not the process number N has reached the maximum channel number L (step S17).

If the process number N has not reached the maximum channel number L yet, the flow returns to step S12 and the same processing will be performed for the next tone-ON channel.

If the process number N has reached the maximum channel number L, the next wave outputting process will be executed.

In this wave outputting process, first, the output port number i is resent to "0" (step S18).

Next, output wave data is read out from the accumulated wave buffer memory 58 onto the i-th output port (step S19).

Then, the output port number i is incremented by "1" (step S20).

Then, it is determined whether or not the output port number i has reached the maximum channel number K (step S21).

If the output port number i has not reached the maximum channel number K yet, the flow returns to step S19 and the same processing is carried out for the next output port number i.

If the output port number i has reached the maximum channel number K, the next process of clearing the accumulated wave buffer memory 58 will be executed.

In this clearing process, first, the output port number i is resent to "0" (step S22).

Next, that area in the buffer memory 58 which corresponds to the output port number i equal to "0" is cleared (step S23).

Then, the output port number i is incremented by "1" (step S24).

Then, it is determined whether or not the output port number i has reached the maximum channel number K (step S25).

If the output port number i has not reached the maximum channel number K yet, the flow returns to step S23 and the same processing is carried out for the next output port number i.

If the output port number i has reached the maximum channel number K, the flow returns to step S11.

According to this embodiment, as described in detail above, a digital filter with the desired frequency response is formed by properly combining a plurality of basic filters based on the timbre code, range data and touch data. This arrangement requires a fewer number of filter coefficients, so that the filter coefficients can easily be switched from one to another and the filtering structure can be simplified. Accordingly, a high-speed filtering process is possible in a high-grade electronic musical instrument, such as the one which time-divisionally generates musical tone signals of multiple tone-ON channels (e.g., 12 channels or 16 channels) and can produce each musical tone signal by composition of multiple musical tone signals.

It should be understood that the first invention is not restricted to the above-described embodiment. For instance, although the foregoing description of the embodiment has been given with reference to the case of generating musical tone signals of a musical instrument, this invention can also be applied to a case of generating musical tone signals of a back chorus, e.g, a fixed formant such as "ah."

Figure 23:
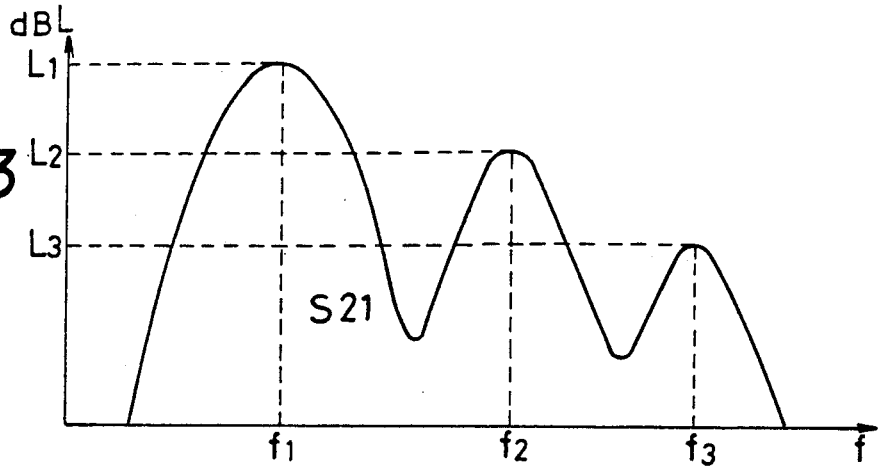
FIGS. 23 to 26 are diagrams of frequency responses for explaining the second embodiment of the first invention.
Figure 24:
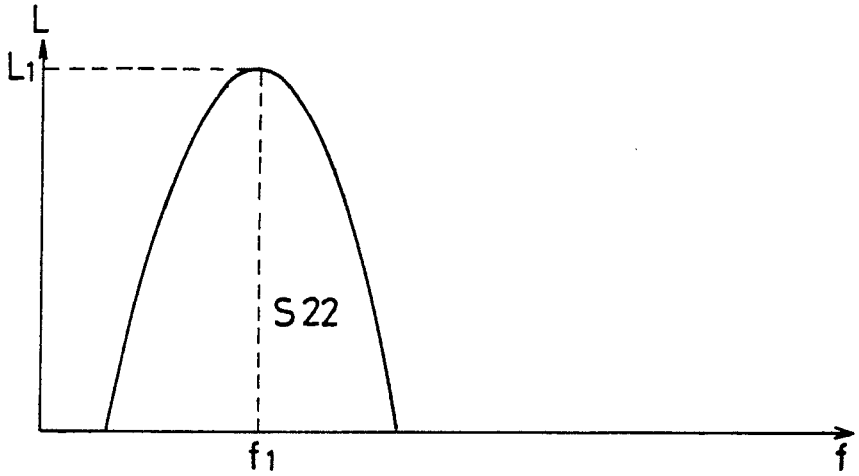
Figure 25:
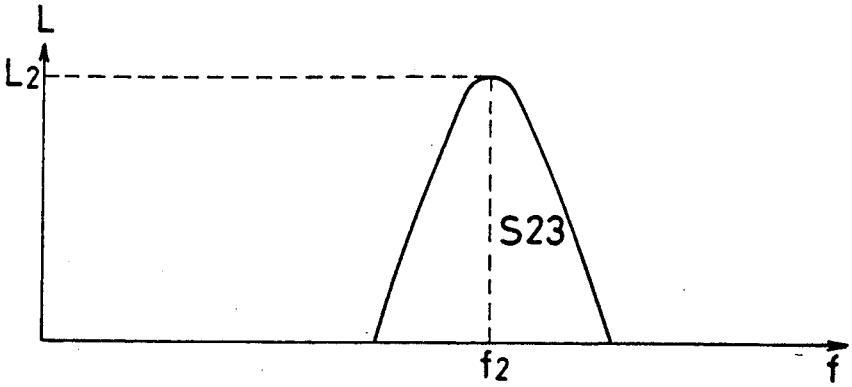
Figure 26:
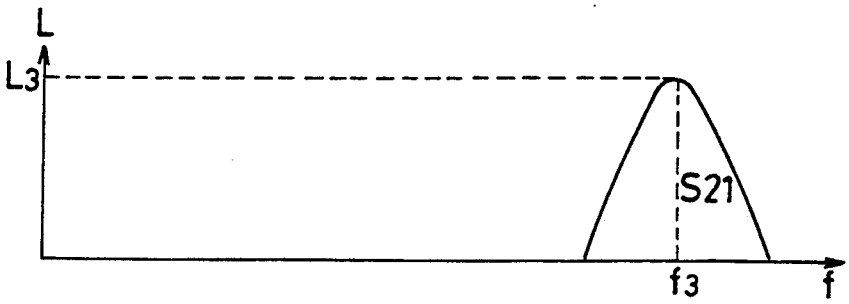

For example, to acquire a fixed formant S21 having the frequency spectrum shown in FIG. 23, signals S22 to S24 having the frequency spectra shown in FIGS. 24–26 have only to be synthesized.

In this case, the individual signals S22–S24 are attained by combining the basic filter F3 in FIG. 5 with the basic filter F4 in FIG. 6. (The output levels L and cutoff frequencies are separately set for the signals S22–S24.)

Although the timbre of a musical tone signal is controlled on the basis of the timbre code, range data and touch data in the above embodiment, this invention can be applied to a case where this control is done using at least one of the data or based on other data than these three.

The second invention will now be discussed.

Figure 27:
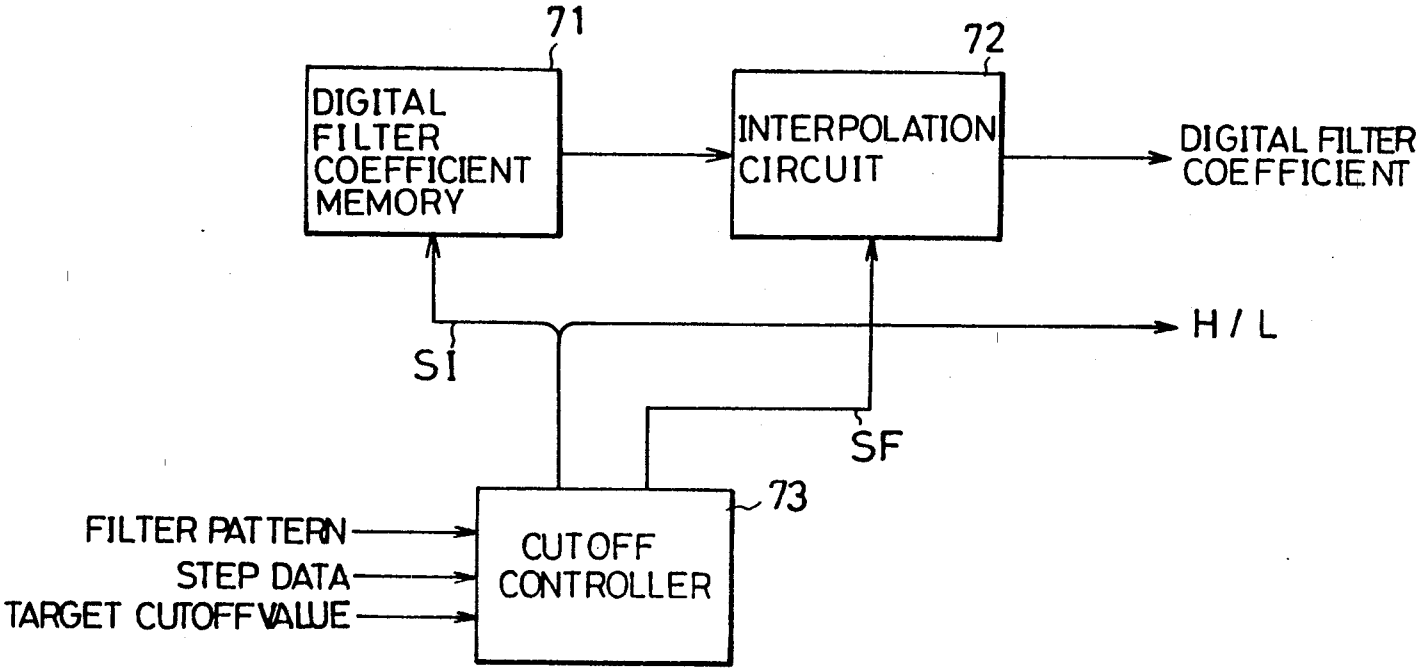
FIG. 27 is a block diagram illustrating a digital coefficient generator shown in FIG. 1 according to the first embodiment of the second invention.

FIG. 27 is a block diagram illustrating the structure of the DCG 20 in FIG. 1 according to the first embodiment of the second invention.

The DCG 20 comprises a digital filter coefficient memory 71, an interpolation circuit 72 and a cutoff controller 73.

The digital filter coefficient memory 71 stores a filter coefficient, which is read out therefrom with integer data SI output from the cutoff controller 73 as an address. The read filter coefficient is supplied to the interpolation circuit 72.

The interpolation circuit 72 performs a predetermined interpolation on the filter coefficient from the digital filter coefficient memory 71 based on fraction data SF output from the cutoff controller 73. The resultant filter coefficient is supplied as a digital filter coefficient to the aforementioned DCF 21.

The cutoff controller 73 generates the integer data SI and fraction data SF based on a filter pattern, step data and an auto cutoff value supplied from the CPU 24.

Part of the integer data SI is further supplied as a select signal H/L for the HPF or LPF to the DCF 21.

The filter pattern, step data and auto cutoff value are produced by the CPU 24 based on the key data and touch data from the keyboard 22 and the timbre selected by the timbre selecting switch on the panel switch 23.

Figure 28:
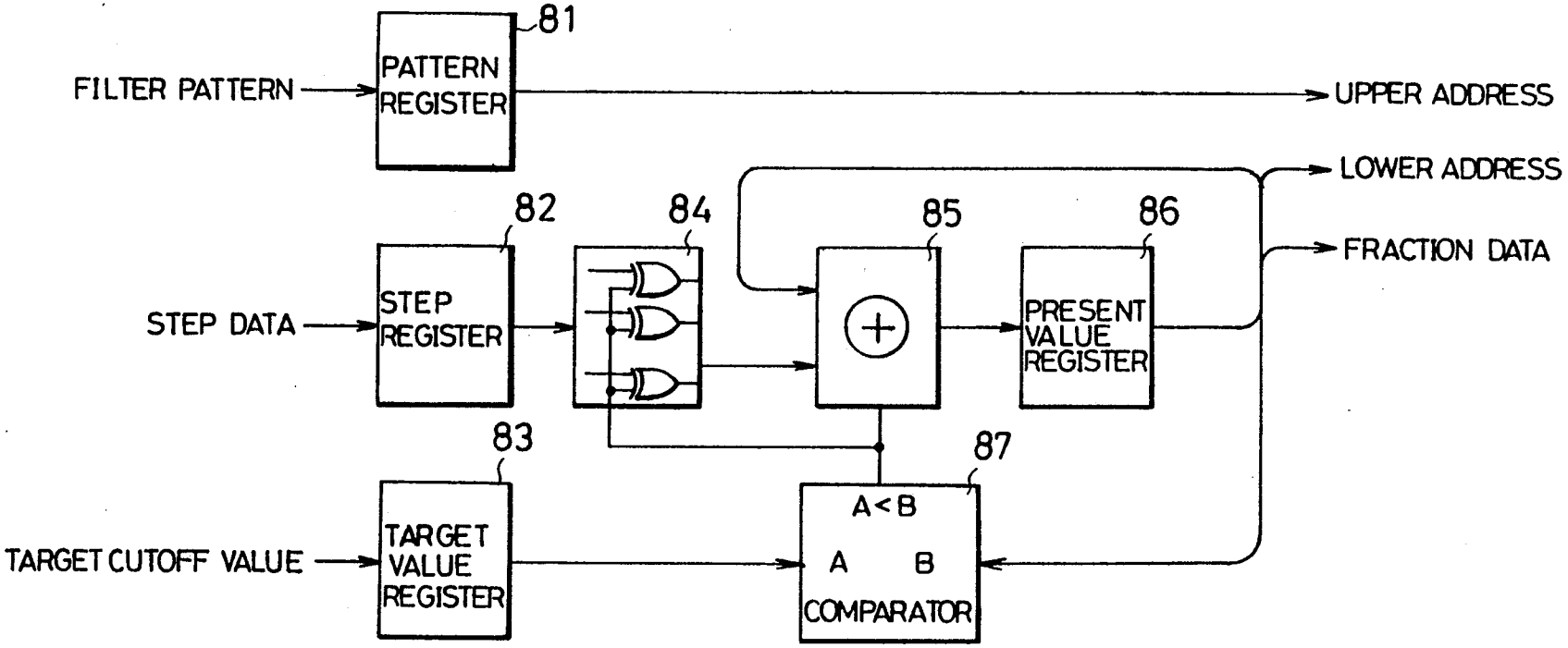
FIG. 28 is a block diagram showing the structure of the first example of a cutoff controller in FIG. 27.

FIG. 28 is a block diagram illustrating the structure of the first example of the cutoff controller 73.

Referring to this diagram, a pattern register 81 temporarily stores the filter pattern from the CPU 24.

The output of the pattern register 81 is sent out as the upper address of the integer data SI. This upper address includes information for selecting the HPF and LPF and information for determining the resonance Q.

A step register 82 temporarily stores step data Δ supplied from the CPU 24. The step data Δ defines the alteration speed.

A target value register 83 temporarily stores the target cutoff value from the CPU 24.

The output of the step register 82 is supplied via an exclusive OR circuit 84 to an adder 85 where the output of the circuit 84 is added to the output of a present value register 86. The result of the addition is set in the present value register 86, which temporarily stores the cutoff value calculated in each calculation period.

A comparator 87 compares the target cutoff value stored in the target value register 83 with the present cutoff value stored in the present value register 86, and outputs a significant value (e.g., high-level signal) if the latter value is greater than the former.

The significant signal is supplied to the exclusive OR circuit 84 and is used as a control signal to permit the step data Δ to pass therethrough directly or after inverted. This significant signal is also supplied to a carry input terminal of the adder 85 to serve together with the inversion operation of the exclusive OR circuit 84 to acquire a 2's complement of the step data Δ.

The integer part of the data set in the Si substrate register 86 is supplied as the lower address of the integer data SI to the digital filter coefficient memory 71. This lower address includes information of the key number. The fraction part of the data in the register 86 is supplied as the fraction data SF to the interpolation circuit 72.

The operation of the cutoff controller 73 with the above structure will be described below.

Figure 29:
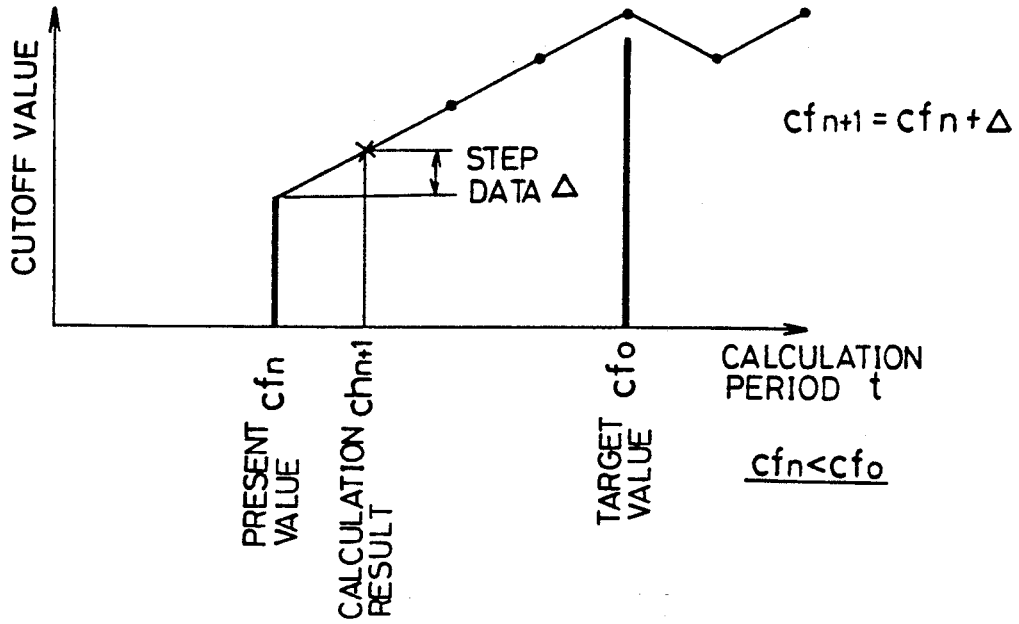
FIGS. 29 and 30 are diagrams for explaining the operation of the cutoff controller shown in FIG. 28.

FIG. 29 presents a diagram for explaining the operation in a case where the target cutoff value cfo is greater than the present value cfn.

In this case, the step data A is added to the present value cfn for each calculation period to make the present value cfn approach the target value cfo.

Since cfn<cfo in this case, the comparator 87 does not output a significant signal. As a result, the step data Δ passes as it is through the exclusive OR circuit 84, and the carry input to the adder 85 becomes "0." Accordingly, the content of the present value register 86 and the step data Δ are added together. The added output becomes a new present value cfn+1.

Figure 30:
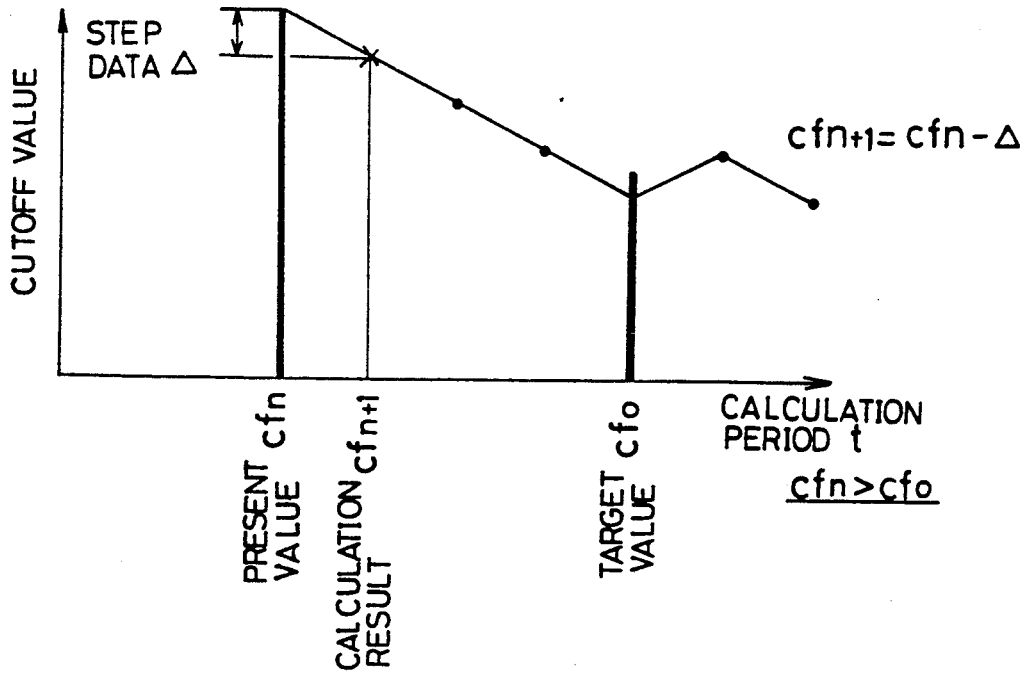

FIG. 30 presents a diagram for explaining the operation in a case where the target cutoff value cfo is smaller than the present value cfn.

In this case, the step data Δ is subtracted from the present value cfn for each calculation period to make the present value cfn approach the target value cfo.

Since cfn>cfo in this case, the comparator 87 outputs a significant signal. As a result, the step data Δ is inverted by the exclusive OR circuit 84, and the carry input to the adder 85 becomes "1." Subsequently, the 2's complement of the step data Δ and the content of the present value register 86 are added together. That is, the step data Δ is subtracted from the present cutoff value cfn. The subtracted output becomes a new present value cfn+1.

The lower address and fraction data are produced in accordance with the calculation period to control the cutoff value in the above manner.

Figure 31:
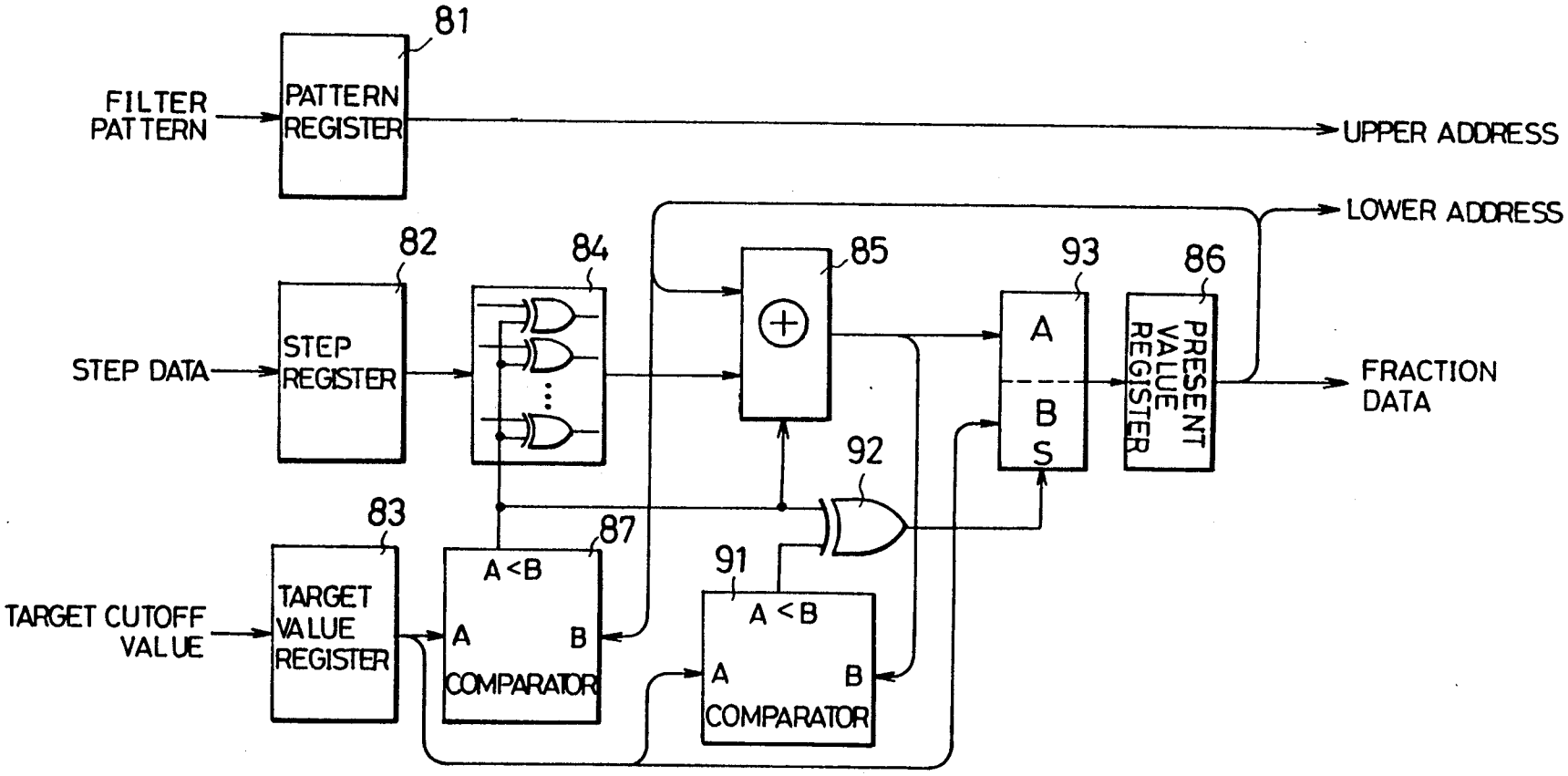
FIG. 31 is a block diagram showing the structure of the second example of the cutoff controller in FIG. 27.

FIG. 31 is a block diagram showing the structure of the second example of the cutoff controller 73.

In the example shown in FIG. 28, the step data Δ is a constant value. With the structure shown in FIG. 28, the cutoff value becomes larger or smaller than the target value cfo as illustrated in FIGS. 29 and 30. In such a case, the compensation is repeated in the calculation period, thus causing the cutoff value to fluctuate around the target value cfo.

The cutoff controller 73 shown in FIG. 31 is designed to prevent the fluctuation of the cutoff value. In this diagram, the same reference numerals as used in FIG. 28 are used to specify the corresponding or identical sections, and their description will be omitted.

Referring to FIG. 31, a comparator 91 compares the output of the target value register 83 with the output of the adder, and outputs a significant value (e.g., high-level signal) if the latter value is greater than the former.

The output of the comparator 91 is supplied to one input terminal of an exclusive OR gate 92 which has the other input terminal supplied with the output of the comparator 87. The output of this exclusive OR gate 92 is sent as a selection signal to a selector 93.

Based the selection signal, the selector 93 selects either the output of the adder 85 or the output of the target value register 83 and sends the selected output to the present value register 86.

The operation of the cutoff controller 73 with the above structure will be depicted below.

Figure 32:
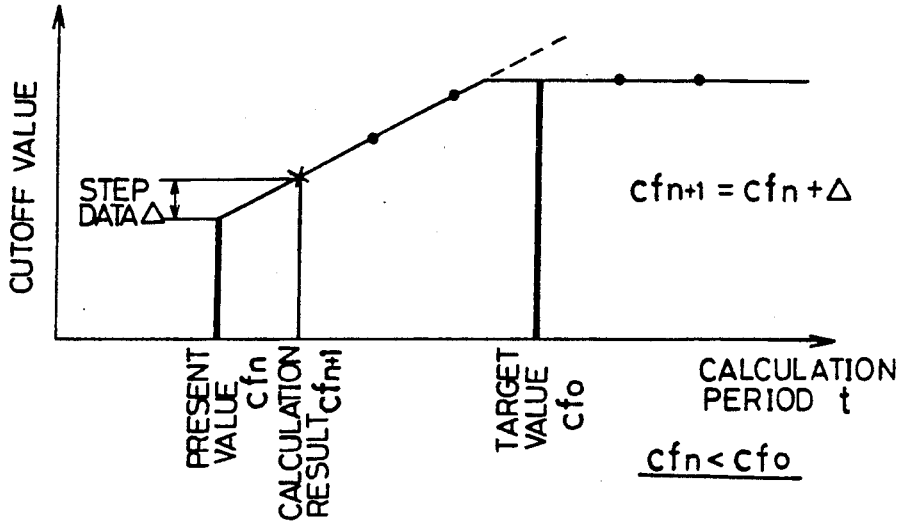
FIGS. 32 and 33 are diagrams for explaining the operation of the cutoff controller shown in FIG. 31.

FIG. 32 presents a diagram for explaining the operation in a case where the target cutoff value cfo is greater than the present value cfn.

In this case, as described above, the step data Δ is added to the present value cfn for each calculation period to make the present value cfn approach the target value cfo.

Since cfn<cfo in this case, the comparator 87 outputs a low-level signal, not a significant signal. As a result, the step data Δ passes as it is through the exclusive OR circuit 84, and the carry input to the adder 85 becomes "0." Consequently, the content of the present value register 86 and the step data Δ are added together.

Since cfn+1<cfo, the output of the compactor 91 has a low level and the output of the exclusive OR gate 92 has a low level as a consequence. Accordingly, the selector 93 selects the A input or the output of the adder 85, permitting the output of the adder 85 to be set in the present value register 86.

Repeating the above operation, the present value cfn approaches the target value cfo. When the present value cfn exceeds the target value cfo, the output of the comparator 91 becomes a high level, making the output of the exclusive OR gate 92 have a high level too. As a result, the selector 93 selects the content of the target value register 83, and the selected content is set in the present value register 86.

As should be apparent from the above, after the cutoff value reaches the target value cfo, the target value itself is output as the cutoff value. The present value cfn therefore always converges to the target value cfo.

Figure 33:
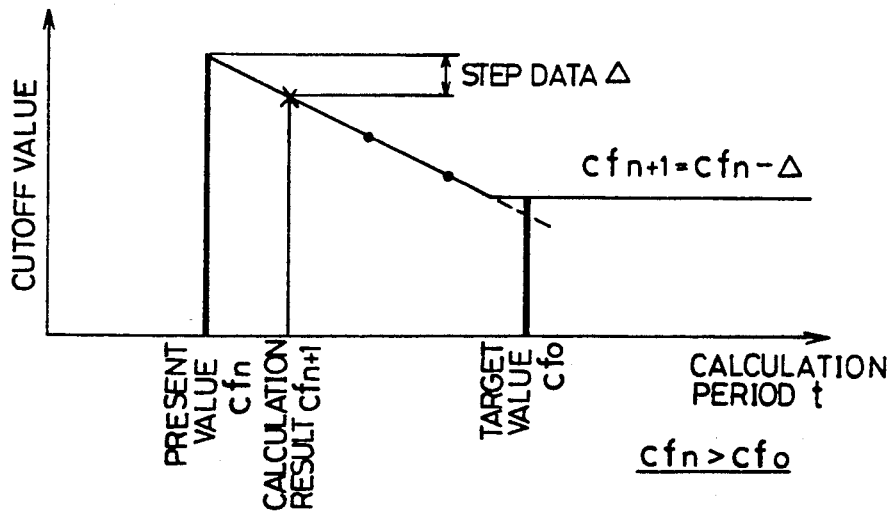

FIG. 33 presents a diagram for explaining the operation in a case where the target cutoff value cfo is smaller than the present value cfn.

In this case, as described above, the step data Δ is subtracted from the present value cfn for each calculation period to make the present value cfn approach the target value cfo.

Since cfn > cfo in this case, the comparator 87 outputs a significant signal (high-level signal). As a result, the step data Δ is inverted by the exclusive OR circuit 84. The significant signal is supplied to the carry input of the adder 85. Subsequently, the 2's complement of the step data Δ and the content of the present value register 86 are added together by the adder 85. That is, the step data Δ is subtracted from the present cutoff value cfn.

Since cfn+1 < cfo, the compactor 91 outputs a high-level signal, setting the output of the exclusive OR gate 92 at a low level. Accordingly, the selector 93 selects the output of the adder 85, which in turn is set in the present value register 86.

Repeating the above operation, the present value cfn approaches the target value cfo. When the present value cfn falls below the target value cfo, the output of the comparator 91 becomes a low level, making the output of the exclusive OR gate 92 have a high level too. As a result, the selector 93 selects the content of the target value register 83, and the selected content is set in the present value register 86.

As should be apparent from the above, after the cutoff value reaches the target value cfo, the target value itself is output as the cutoff value. The cutoff value therefore always converges to the target value cfo.

The cutoff controller 73 produces the lower address and fraction data in accordance with the calculation period to control the cutoff value in the above manner.

The detailed description of the interpolation circuit 72 will now be given.

To begin with, the concept of the interpolation will be discussed.

As the cutoff value is digitally determined, the filter characteristic becomes discrete, thus making it easier to generate noise. The interpolation is executed to prevent the generation of the noise. The interpolation smooths the filter characteristic to thereby provide clear musical tone signals free of noise.

Figure 34:
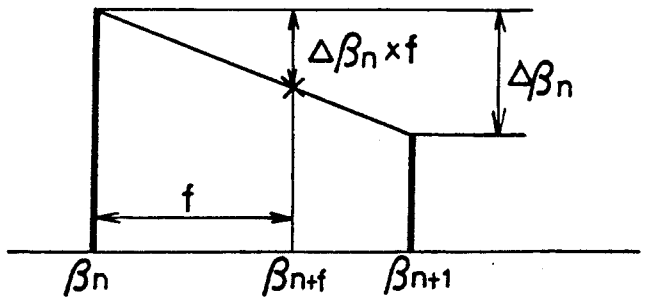
FIG. 34 is a diagram for explaining an interpolation process.

FIG. 34 is presented for explanation of the operation for the interpolation about a filter coefficient Δ.

The different $\Delta\beta_n$ between coefficients $\beta_n$ and $\beta_{n+1}$ is acquired by $\beta_{n+1}-\beta_n$. Given that the fraction data is f ($0 \leqq f < 1$) and the coefficient for this fraction data f is $\beta_{n+1}$, the coefficient $\beta_{n+1}$ is obtained from the following equation (1).

$$\begin{aligned} \beta_{n+f} &= \beta_n + (\beta_{n+1} - \beta) \times f \\ &= \beta_n + \Delta\beta_n \times f \end{aligned} \quad (1)$$

Figure 35:
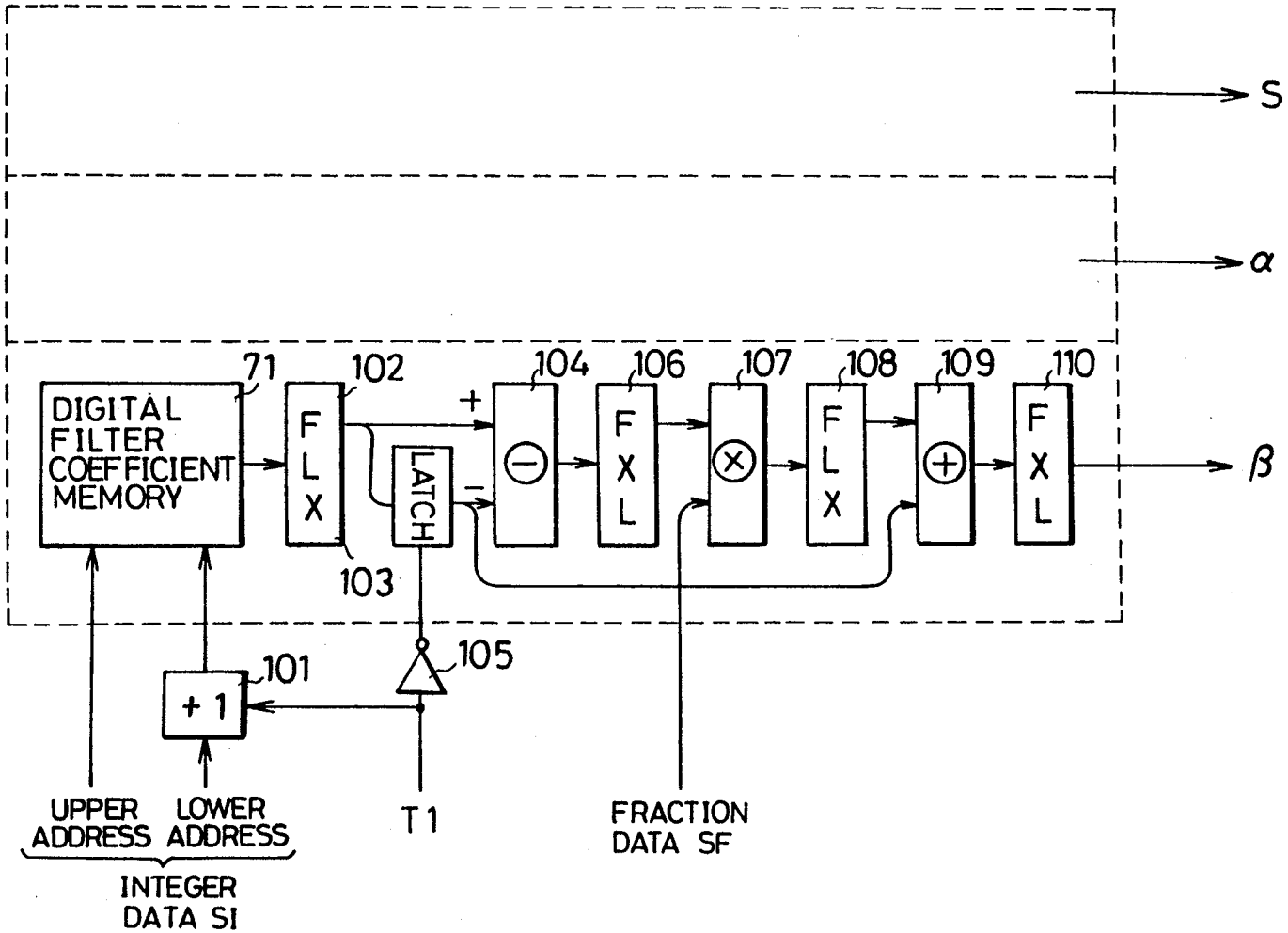
FIG. 35 is a block diagram illustrating the structure of the first example of an interpolation circuit shown in FIG. 27.

FIG. 35 is a block diagram showing the structure of the first example of the interpolation circuit 72 to realize the above function; the illustrated circuit is only for the coefficient $\beta$. As the interpolation circuits for the digital filter coefficients $\alpha$ and S have the same structure as the one for the digital filter coefficient $\beta$, they will not be illustrated.

Data in the digital filter coefficient memory 71 is stored in a floating point form consisting of a fraction part and power part because this form can have a wider range for expressing numerals.

The upper address given from the cutoff controller 73 is supplied as it is to the digital filter coefficient memory 71, while the lower address is supplied to the memory 71 after incremented by an incrementer 101. The incrementer 101 increments the lower address in synchronism with a timing signal T1 generated by the interpolation circuit.

Data of the floating point form read out from the digital filter coefficient memory 71 is transformed into data of a fixed point form by a floating point/fixed point transform circuit (hereinafter referred to as "FLX") 102.

The transformed output is supplied to a latch circuit 103 and an add terminal of a subtracter 104. The data sent to the latch circuit 103 is latched there by the timing signal T1 inverted by an inverter 105. The latched data is supplied to a subtract terminal of the subtracter 104.

The subtracter 104 subtracts the output of the latch circuit 103 from the output of the FLX 102. The subtracted output is transformed into data of the floating point form by a fixed point/floating point transform circuit (hereinafter referred to as "FXL") 106.

The transformed output is multiplied by the fraction data SF from the cutoff controller 73 by a multiplier 107. The multiplied output is transformed again into data of the fixed point form by an FLX 108.

The transformed output is added to the output of the latch circuit 103 by an adder 109. The result of the addition is again transformed into data of the floating point form by an FXL 110. The transformed output is supplied as the digital filter coefficient $\beta$ to the DCF 21.

Figure 36:
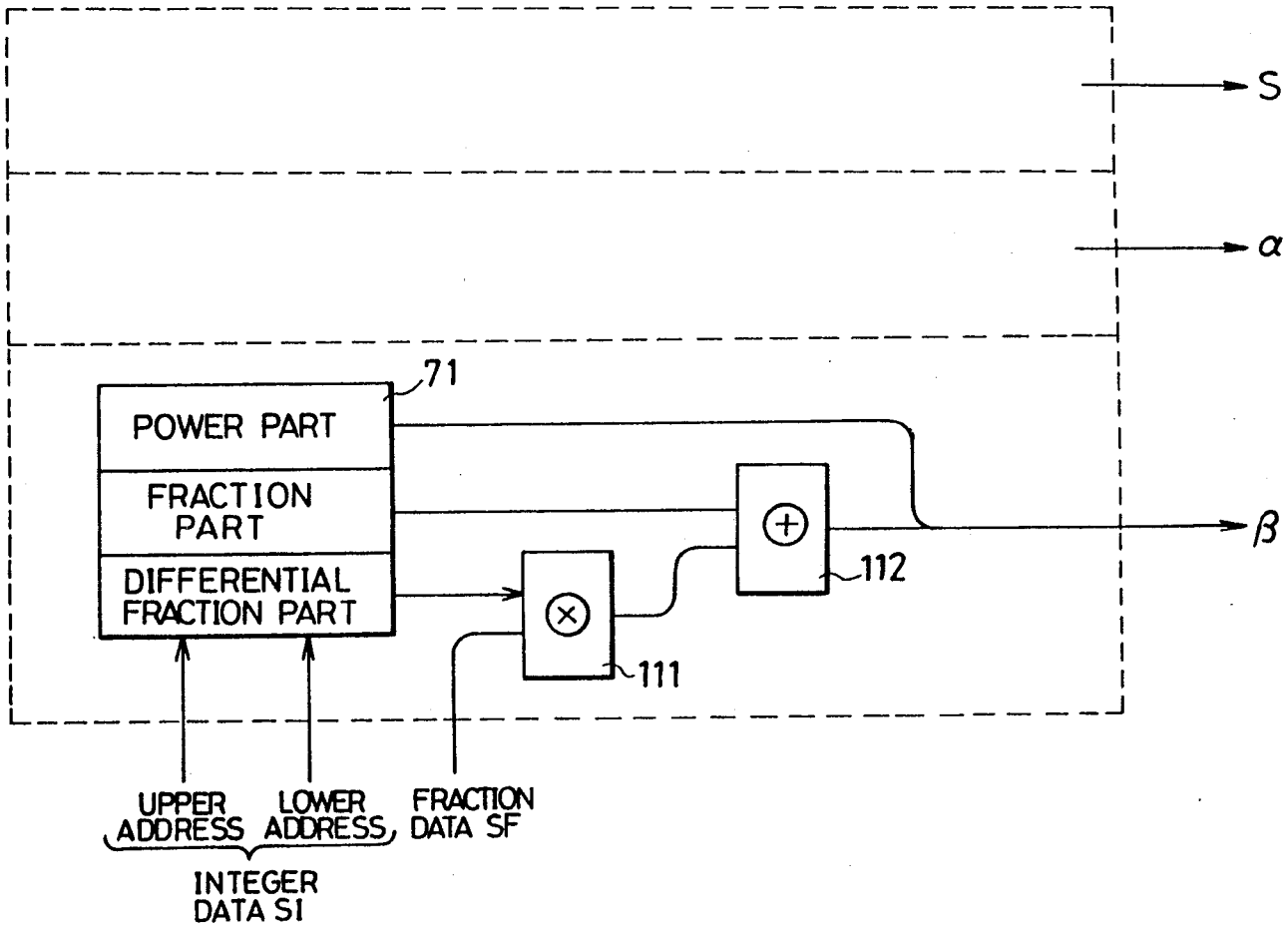
FIG. 36 is a block diagram illustrating the structure of the second example of the interpolation circuit shown in FIG. 27.

FIG. 36 is a block diagram illustrating the structure of the second example of the interpolation circuit.

According to the first example of the interpolation circuit in FIG. 35, the digital filter coefficient memory 71 stores data consisting of the power part and power part, whereas, according to the circuit shown in FIG. 36, the memory 71 stores data of a differential fraction part with the same power part in addition to the power part and fraction part.

This design can eliminate the need for the transform circuits 102, 106, 108 and 110 for transform between fixed point data and floating point data, the latch circuit 103 and the subtracter 104, which are all required in the interpolation circuit shown in FIG. 35. As a result, the hardware scale can be reduced and high-speed processing can be realized.

Referring to FIG. 36, when the upper and lower addresses constituting the integer data SI are given to the digital filter coefficient memory 71, data of the corresponding power part and fraction part and data of the differential fraction part are read out therefrom at a time.

The data of the differential fraction part is multiplied by the fraction data SF from the cutoff controller 73 by a multiplier 111. The multiplied output is added by and adder 112 to the data of the fraction part read out from the digital filter coefficient memory 71. The result of the addition is output as data of the fraction part of the digital filter coefficient $\beta$. The data of the power part read out from the digital filter coefficient memory 71 is used as it is as data of the power part of the digital filter coefficient $\beta$.

The above arrangement can realize a simpler and high-speed interpolation circuit 72.

As the interpolation circuits for the digital filter coefficients $\alpha$ and S have the same structure as the one for the digital filter coefficient $\beta$, their explanation will be omitted.

Figure 37:
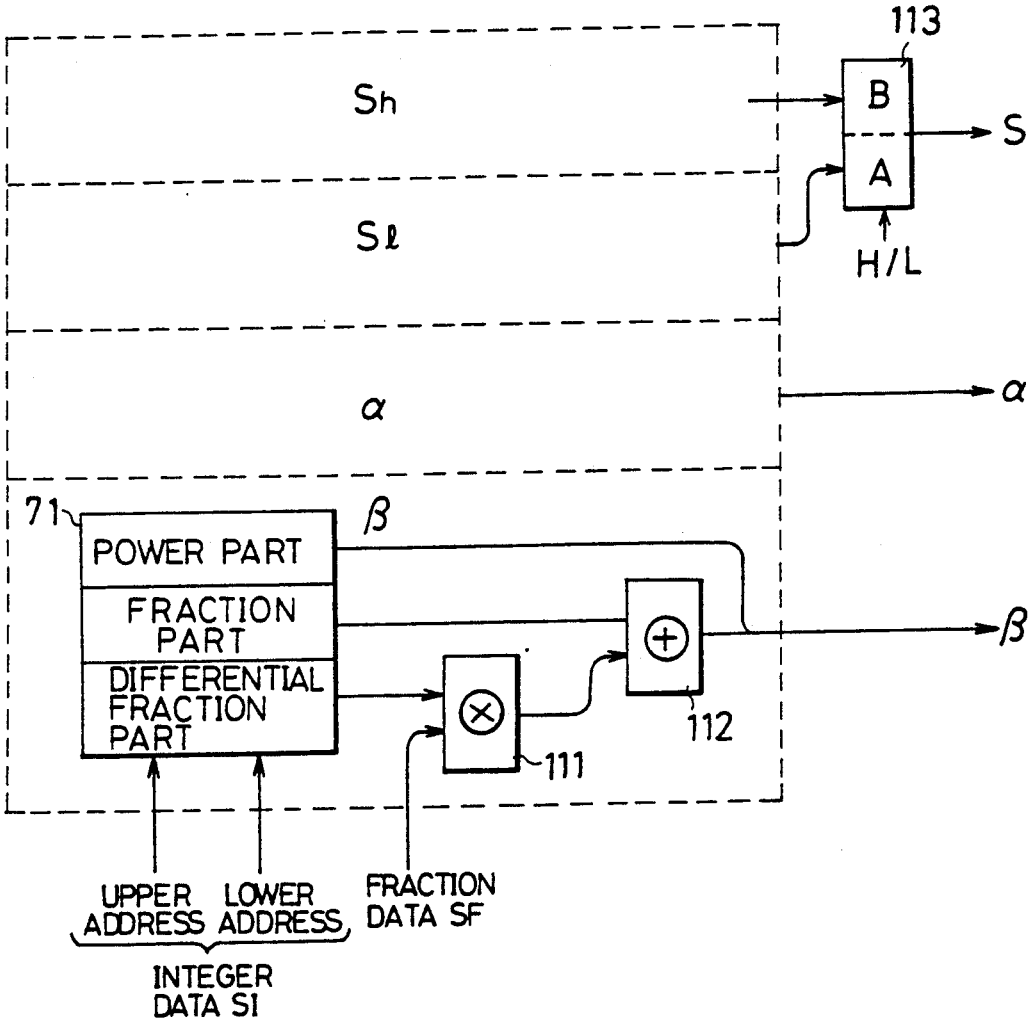
FIG. 37 is a block diagram illustrating the structure of the third example of the interpolation circuit shown in FIG. 27.

FIG. 37 is a block diagram illustrating the third example of the interpolation circuit.

The structure shown in FIG. 36 needs that the interpolation circuit for the HPF and the interpolation for the LPF be separately provided. Since the first two of the digital filter coefficients $\alpha$, $\beta$ and S can be shared by the HPF and LPF, however, only the digital filter coefficient S needs to be prepared for each filter.

In consideration of this point, two types of coefficients, Sh for the HPF and Sl for the LPH, are prepared only for the digital filter coefficient S and one of them is selected by a selector 113 according to this embodiment. More specifically, the selector 113 selects the coefficient Sl as the digital filter coefficient S when the select signal H/L from the cutoff controller 73 specifies the LPF, and selects the other coefficient Sh when the select signal H/L specifies the HPF.

The above arrangement can reduce the memory capacity of the digital filter coefficient memory 71 and reduce the hardware scale.

Although the above description has been given with reference to the case where interpolation processes for the digital filter coefficients $\alpha$, $\beta$ and S are simultaneously executed by a parallel circuit, the interpolation may be time-divisionally performed by a serial circuit. It should be easily understood that, in this case, the selector 113 for Sh and Sl becomes a selector for an address signal in the time-divisional processing.

The structure of the DCF 21 in FIG. 1 according to the second invention will now be described.

Figure 38:
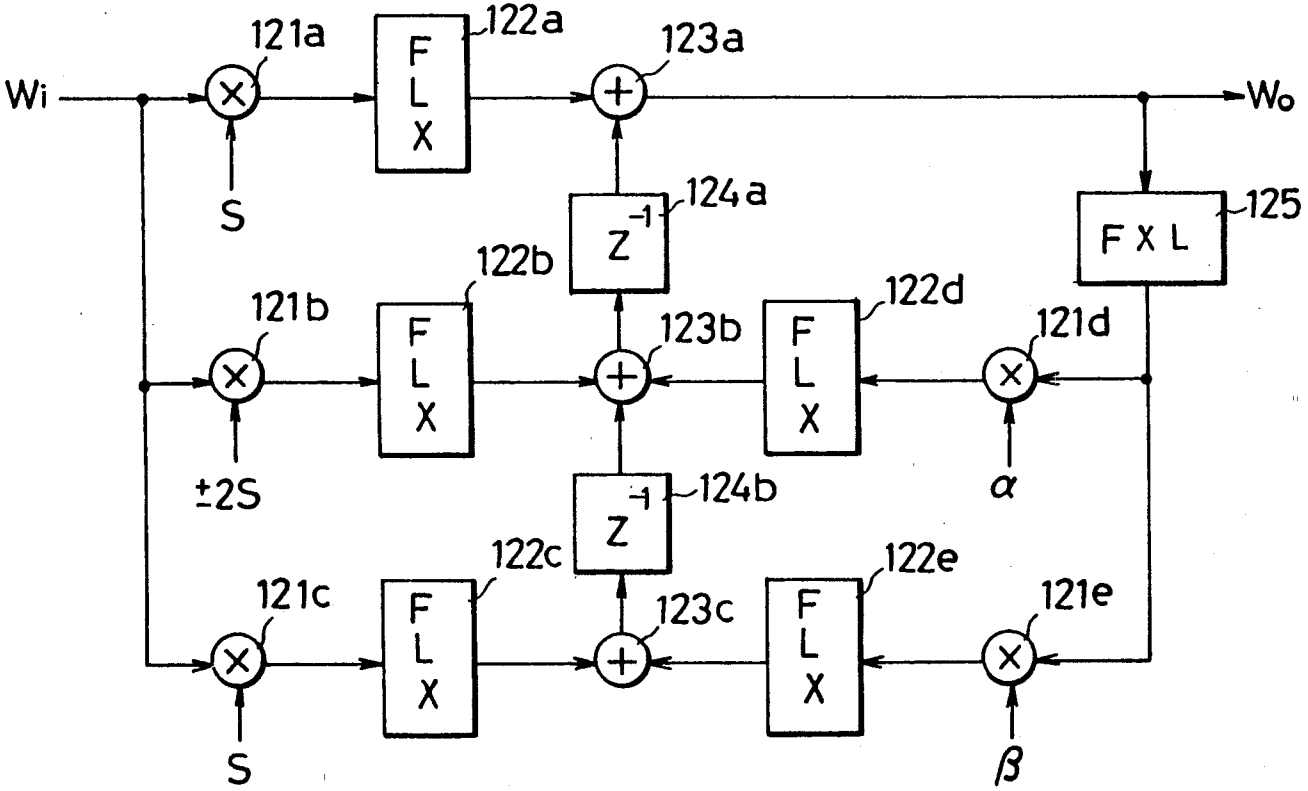
FIG. 38 is a block diagram illustrating a digital controlled filter according to the first embodiment of the second invention.

FIG. 38 is a block diagram illustrating the basic structure of the IIR type digital filter used as the DCF 21.

In the illustrated filter, the input signal Wi is data of a floating point form, while the output signal Wo is data of a fixed point form.

Referring to FIG. 38, reference numerals "121*a*" to "121*e*" denote multipliers to perform floating point multiplication. The multipliers 121*a* and 121*c* receive the digital filter coefficient S. The musical tone signal 121*b* receives "+2S" when the LPF is selected, and "−2S" when the HPF is selected. The multiplier 121*d* receives the digital filter coefficient $\alpha$, and the multiplier 121*e* the digital filter coefficient $\beta$.

Reference numerals "122*a*" to "122*e*" denote FLXs to transform floating point data into fixed point data.

Reference numerals "123*a*" to "123*c*" are adders, and "124*a*" and "124*b*" are delay circuits to delay a unit-time part.

Reference numeral "125" denotes an FXL to transform fixed point data into floating point data.

The above elements when connected as illustrated constitute the IIR type digital filter.

Figure 39:
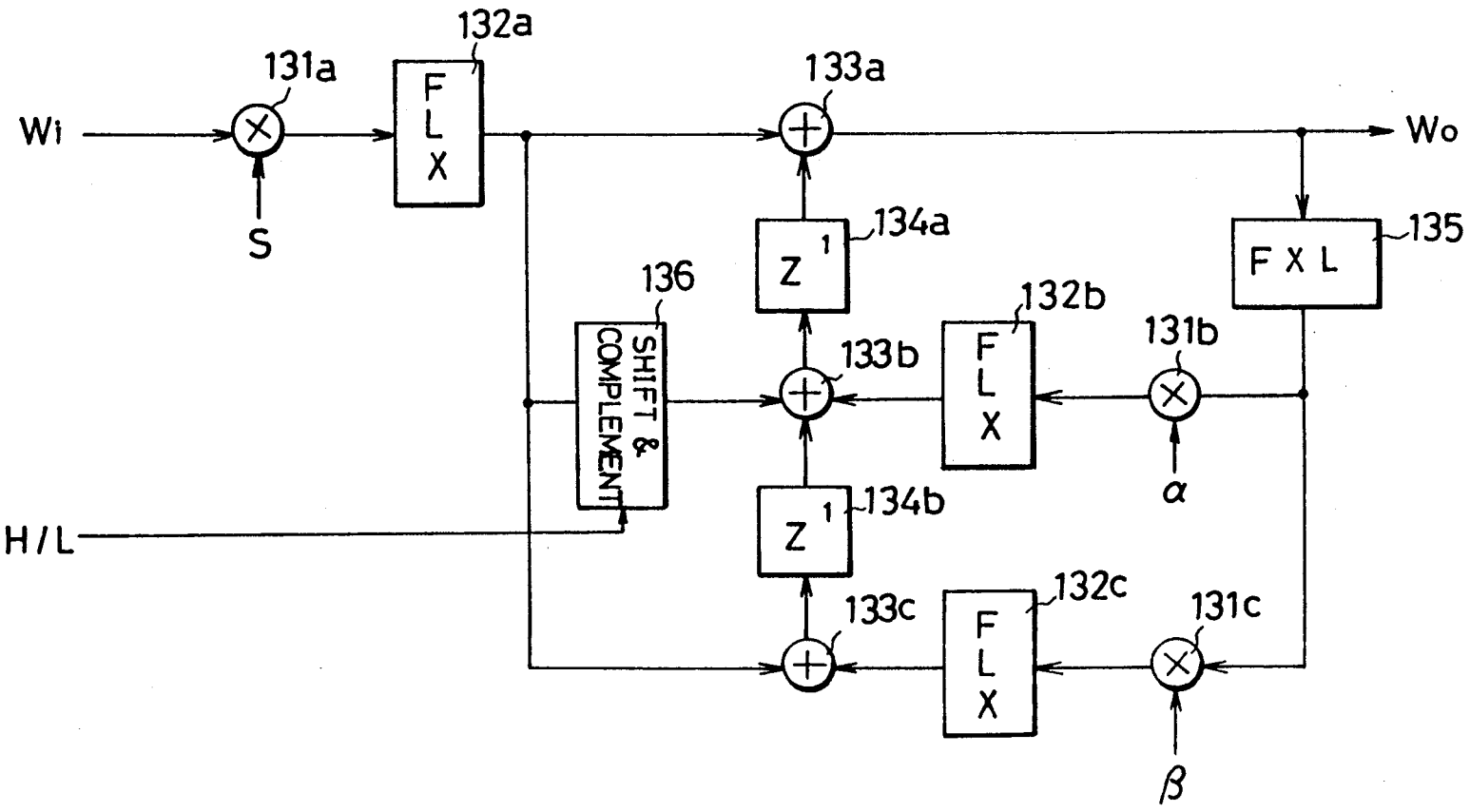
FIG. 39 is a block diagram illustrating a digital controlled filter according to the second embodiment of the second invention.

FIG. 39 is a block diagram showing the structure of the DCF 21 according to one embodiment, which has the basic structure of the IIR type digital filter in FIG. 38 simplified, thus reducing the amount of the required hardware.

The input signal Wi is likewise data of a floating point form supplied from the DCO 19, while the output signal Wo is data of a fixed point form. This output signal Wo is supplied to the DCA 18.

Referring to FIG. 39, reference numerals "131*a*" to "131*c*" denote multipliers to perform floating point multiplication. The multipliers 131*a* and 131*c* receive the digital filter coefficients S, $\alpha$ and $\beta$ from the interpolation circuit 72.

Reference numerals "132*a*" to "132*c*" denote FLXs to transform floating point data into fixed point data.

Reference numerals "133*a*" to "133*c*" are adders, and "134*a*" and "134*b*" are delay circuits to delay a unit-time part.

Reference numeral "135" denotes an FXL to transform fixed point data into floating point data.

Reference numeral "136" denotes a shift and complement circuit. The shift/complement circuit 136 provides an output two times or −2 times greater than the output of the FLX 132 based on the select signal H/L. More specifically, the shift/complement circuit 136 performs the shifting operation to provide data "+2" times the input data when the select signal H/L specifies the LPF, and performs the shifting operation with a 2's complement to provide data "−2" times the input data when the select signal H/L specifies the HPF.

The above elements when connected as illustrated constitute the IIR type digital filter.

The above arrangement can reduce the number of the multipliers and FLXs compared with the structure in FIG. 38, thus reducing the amount of the required hardware.

Figure 40:
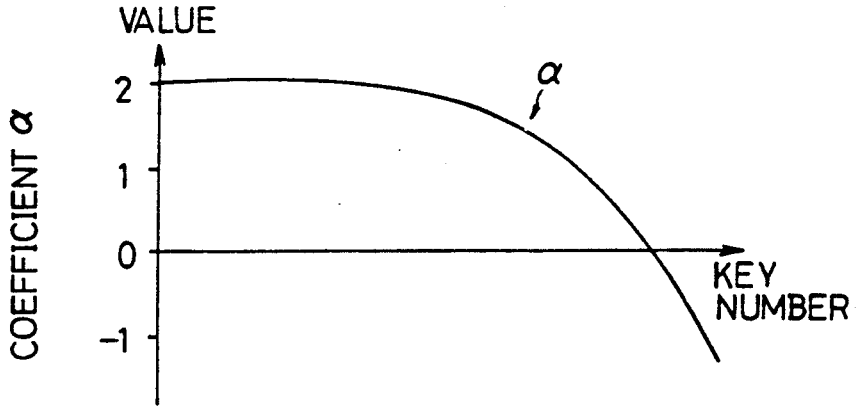
FIGS. 40 to 42 are diagrams of frequency responses exemplifying the functions of a digital filter coefficient.
Figure 41:
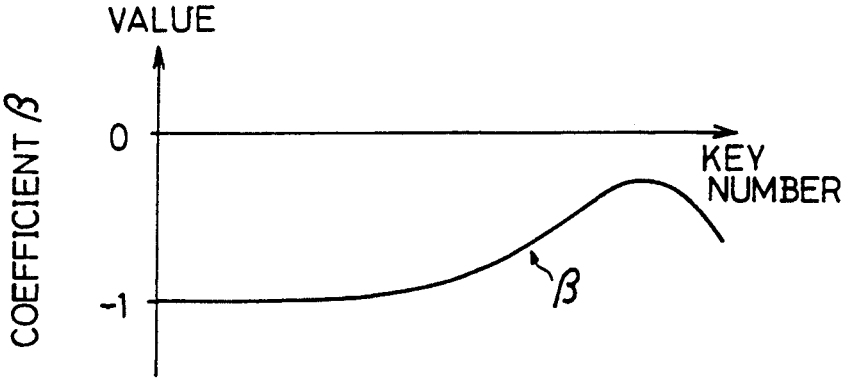
Figure 42:
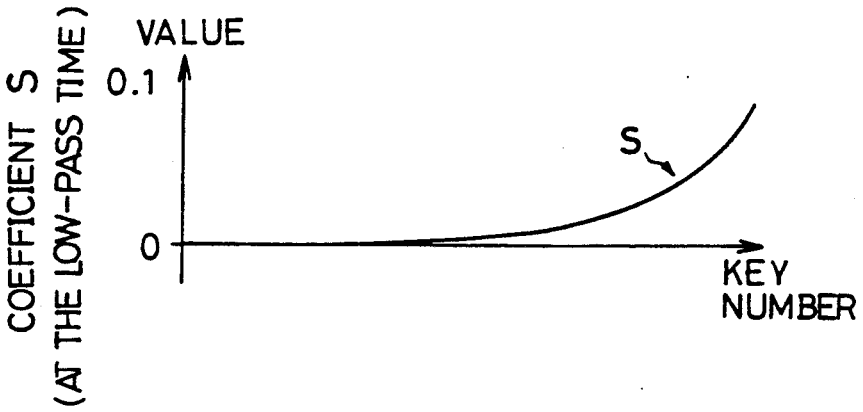

FIGS. 40 to 42 illustrate examples of functions of the digital filter coefficients $\alpha$, $\beta$ and S supplied to the DCF 21.

Referring to these diagrams, the vertical scale is the value of the coefficient, and the horizontal scale is a key number which is given to each key on the keyboard 22. Based on the key number, the digital filter coefficients $\alpha$, $\beta$ and S in use change.

The digital filter coefficients $\alpha$, $\beta$ and S to be stored in the digital filter coefficient memory 71 and the digital filter coefficients $\alpha$, $\beta$ and S to be output from the interpolation 72 are controlled to have the above functions.

As described in detail above, the filtering is done by a digital filter according to this embodiment, smooth musical tone signals can be generated. This is because the digital filter coefficients $\alpha$, $\beta$ and S are interpolated by the interpolation 72 and the output of the DCO 19 is filtered using the interpolated digital filter coefficients.

Further, it is possible to have a wider range for expressing the digital filter coefficients $\alpha$, $\beta$ and S because the digital filter coefficients $\alpha$, $\beta$ and S are stored in a floating point form in the digital filter coefficient memory 71.

The structure shown in FIG. 37 can permit the interpolation to be performed with a simple structure and at a high speed. This is because that with the power part being common, the digital filter coefficients $\alpha$, $\beta$ and S are stored in a floating point form having an effective value and a differential effective value in the fraction part. That is, the illustrated structure can eliminate the calculation for the differential effective value, thus reducing the amount of the required calculation.

The structure shown in FIG. 37 can reduce the memory capacity of the digital filter coefficient memory 71 because the digital filter coefficients $\alpha$ and $\beta$ are commonly used for the HPF and LPF and coefficients Sh and Sl associated with the individual filters are prepared only for the digital filter coefficient S.

Although one embodiment of the second invention has been described above, the second invention is not restricted to this particular type. For instance, although the description of this embodiment has been given with reference to the case of executing the interpolation while changing the cutoff value with time, the interpolation may be done while changing the Q value with time. That is, the cutoff value may be replaced with the Q value.

Further, a few circuits may be added to interpolate both the cutoff value and Q value. Furthermore, the individual calculations may be performed on the time-divisional basis.

What is claimed is:

1. An electronic musical instrument comprising:
musical tone signal outputting means for outputting a musical tone signal having a frequency according to a pitch;
control information outputting means for outputting control information for controlling a timbre of said musical tone signal output from said musical tone signal outputting means;
filter combining means for combining a plurality of basic filters having flat and different frequency responses based on said control information from said control information outputting means; and
timbre control means for filtering said musical tone signal from said musical tone signal outputting means using said basic filters combined by said filter combining means to thereby control said timbre of said musical tone signal.

2. An electronic musical instrument according to claim 1, wherein said filter combining means is designed so as to form said basic filters time-divisionally.

3. An electronic musical instrument according to claim 2, wherein said timbre control means includes:
storage means having a plurality of memory areas;
synthesizing means for synthesizing a read output of said storage means and filtered outputs of said basic filters;
write means for selectively writing said musical tone signal from said musical tone signal outputting means, said filtered outputs of said basic filters and a synthesized output of said synthesizing means into said storage means based on said control information; and
read means for selectively reading a signal from said storage means and supplying said read signal to said storage means and said synthesizing means based on said control information.

4. An electronic musical instrument according to claim 1, wherein said control information is timbre select information.

5. An electronic musical instrument according to claim 1, wherein said control information is range information.

6. An electronic musical instrument according to claim 1, wherein said control information is touch information representing a touched state of a key.

7. An electronic musical instrument using filters for timbre control comprising:
musical tone signal outputting means for outputting a musical tone signal having a frequency according to a pitch;
storage means for storing filter coefficients to control a timbre of said musical tone signal output from said musical tone signal outputting means;
data output means for repeatedly preparing and outputting integer data and fraction data, which vary with time;
filter coefficient read means for reading out filter coefficients from said storage means using said integer data as an address;
filter coefficient interpolation means for interpolating said read-out filter coefficients based on said fraction data; and
filter means for filtering said musical tone signal from said musical tone signal outputting means based on said filter coefficients interpolated by said filter coefficient interpolation means to thereby control said timbre of said musical tone signal.

8. An electronic musical instrument according to claim 7, wherein said storage means is designed to store said filter coefficients in a floating point form consisting of a power part and a fraction part.

9. An electronic musical instrument according to claim 7, wherein said storage means is designed to store said filter coefficients in a floating point form having a an effective value and a differential effective value in a fraction part with a power part being common.

10. An electronic musical instrument according to claim 7, wherein said storage means includes:
first memory means for storing those filter coefficients which are commonly used for a high-pass filter and a low-pass filter;
second memory means for storing that filter coefficient used only for said high-pass filter;
third memory means for storing that filter coefficient used only for said low-pass filter; and
select means for selecting one of said filter coefficients stored in said second and third memory means based on select information for said high-pass filter and said low-pass filter.

* * * * *